US007207557B2

(12) United States Patent
Kaneko et al.

(10) Patent No.: US 7,207,557 B2
(45) Date of Patent: Apr. 24, 2007

(54) IMAGE FORMING SYSTEM AND SINGLE-SHEET PROCESSING MACHINE

(75) Inventors: Masahiro Kaneko, Tokyo (JP); Toshio Shida, Tokyo (JP); Kazuhiro Hirota, Tokyo (JP); Kazuo Sato, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 157 days.

(21) Appl. No.: 10/802,757

(22) Filed: Mar. 18, 2004

(65) Prior Publication Data

US 2004/0247356 A1 Dec. 9, 2004

(30) Foreign Application Priority Data

Jun. 4, 2003 (JP) ..... 2003-159109

(51) Int. Cl.
*B65H 33/04* (2006.01)

(52) U.S. Cl. ..... 270/58.08; 270/58.09; 270/58.1

(58) Field of Classification Search ..... 270/58.08, 270/58.09, 58.1, 58.11, 58.12, 58.13, 58.14, 270/58.15, 58.16, 58.17, 58.18; 399/410
See application file for complete search history.

(56) References Cited

U.S. PATENT DOCUMENTS 5,592,881 A * 1/1997 Rabjohns ..... 101/483
2003/0116599 A1* 6/2003 Lamothe ..... 226/20
2003/0168796 A1* 9/2003 Suzuki et al. ..... 270/58.07

FOREIGN PATENT DOCUMENTS

| | | | |
|---|---|---|---|
| EP | 0 652 178 A1 | | 5/1995 |
| JP | 2002003069 A | * | 1/2002 |
| JP | 2002-128384 | | 5/2002 |
| JP | 2002316488 A | * | 10/2002 |
| JP | 2002326473 A | * | 11/2002 |
| WO | WO 92/12087 | | 7/1992 |

OTHER PUBLICATIONS

European Search Report.

* cited by examiner

*Primary Examiner*—Douglas Hess
(74) *Attorney, Agent, or Firm*—Finnegan, Henderson, Farabow, Garrett & Dunner, L.L.P.

(57) ABSTRACT

An image forming system enabling a cost reduction by decreasing the number of components and having enough performance levels of individual postprocessing functions, comprising: an image forming apparatus body and at least one postprocessing unit, the postprocessing unit selectable from a plurality of types of postprocessing units, wherein a single-sheet processing machine is provided as one of the plurality of types of postprocessing units and wherein the single-sheet processing machine has a plurality of types of single-sheet processing functions for postprocessing in units of a sheet and a sheet attachment function of attaching a cover sheet or an insert sheet to an output sheet bulk.

24 Claims, 24 Drawing Sheets

FIG. 6A
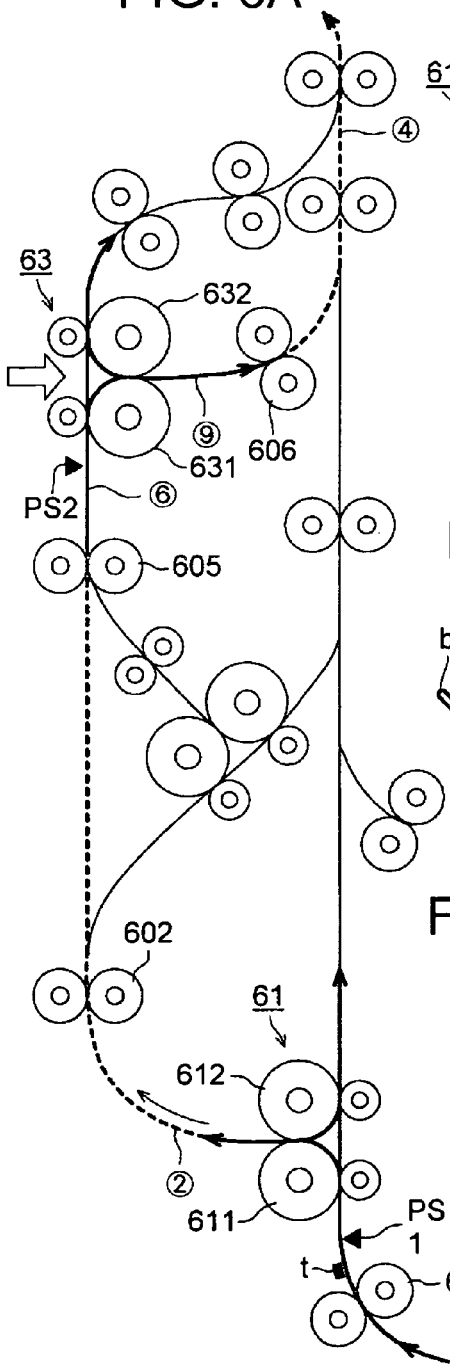
FIG. 6B
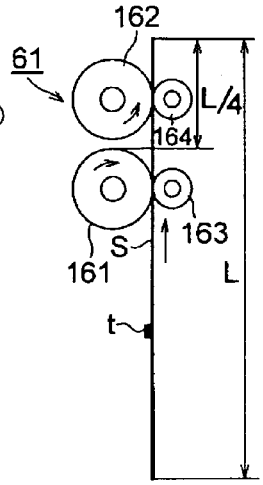
FIG. 6C
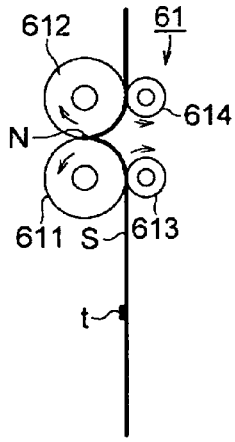
FIG. 6D
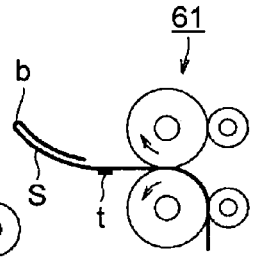
FIG. 6E
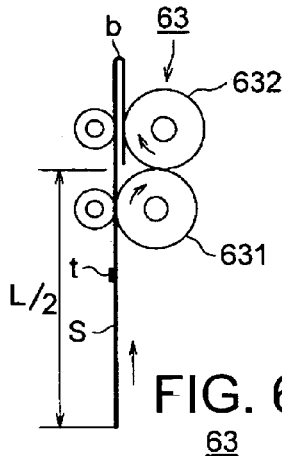
FIG. 6F
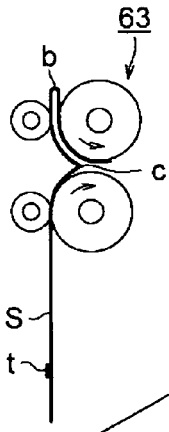
FIG. 6G
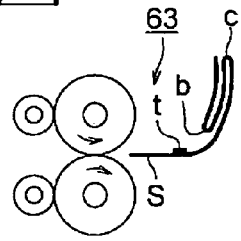
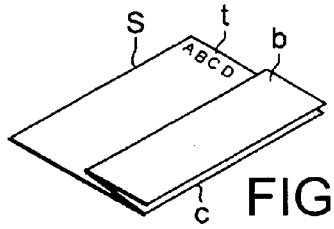
FIG. 6H

IMAGE FORMING SYSTEM AND SINGLE-SHEET PROCESSING MACHINE

BACKGROUND OF THE INVENTION

1. Field of the Invention

The present invention relates to an image forming system capable of performing various postprocessing for sheets already recorded in an image forming apparatus body, and more particularly to an image forming system in which one or more types of desired postprocessing units among a plurality of postprocessing units can be selectively attached to the image forming apparatus body and to a single-sheet processing machine arranged in such a way as to be able to be selectively attached to the image forming system.

2. Description of the Prior Arts

Conventionally, there has been disclosed an image forming system in which a postprocessing unit having functions of punching, binding, and folding sheets after image recording can be attached to a copying machine as an image forming apparatus, for example, in Japanese Patent Publication (Kokai) No. 2002-128384. This type of image forming system has a single postprocessing unit capable of handling various postprocessing functions, and therefore it is useful when installed in such an environment that various users make a wide variety of uses of the system such as, for example, in an office. Furthermore, the postprocessing unit is relatively compact in size and thus useful in an office requiring space saving in this regard, too. Since the system enables various postprocessing functions using a single relatively compact postprocessing unit, however, the function levels are not necessarily sufficient when focusing only on individual postprocessing functions. For example, if the image forming system is used as a near-print system, the level need be higher than the level of the postprocessing function required for the image forming system used in an office or the like, but it does not reach the level enough to satisfy the requirement.

Furthermore, for example, if it is used as a print on demand system, the system need not always satisfy all kinds of postprocessing functions, but it is only required to have satisfactory performances of specific postprocessing functions. In other words, if it is used as a print on demand system, specific users use more frequently only specific postprocessing functions more often than various users make various uses.

A consideration is being taken on an image forming system based on an image forming apparatus such as a copying machine or a printer with focusing on a print on demand. Thereby, there has been an attempt of unifying postprocessing units for each postprocessing function and enhancing the performance of the postprocessing function. This type of image forming system, however, is very large in size.

SUMMARY OF THE INVENTION

To resolve the above problems, the present invention has been provided. Therefore, it is an object of the present invention to provide a downsized image forming system with a cost reduced by decreasing the number of components and having enough performance levels of individual postprocessing functions.

The above object is achieved by the following image forming system of the present invention:

(1) An image forming system, comprising an image forming apparatus body and at least one postprocessing unit selectively attached thereto among a plurality of types of attachable postprocessing units, wherein at least one postprocessing unit stated above is a single-sheet processing machine for postprocessing sheet in units of a sheet and wherein the single-sheet processing machine has a plurality of types of single-sheet processing functions of postprocessing sheet in units of a sheet and a sheet attachment function of attaching a cover sheet or an insert sheet to an output sheet bulk.

(2) The image forming system according to the above (1), wherein the single-sheet processing machine has all single-sheet processing functions of postprocessing sheet in units of a sheet. This enables further downsizing of the entire image forming system. The term "all single-sheet processing functions of postprocessing paper in units of a sheet in the image forming system" has a meaning of all postprocessing functions performed for paper discharged from the image forming apparatus body.

(3) The image forming system according to the above (1), wherein the single-sheet processing function is one of a punching function of punching sheet in units of a sheet, a folding function of folding sheet in units of a sheet, a perforating function of perforating sheet in units of a sheet, and a single-sheet cutting function of cutting sheet in units of a sheet.

This enables the single-sheet processing machine to have at least two single-sheet processes among the punching function, the folding function, the perforating function, and the single-sheet cutting function.

(4) The image forming system according to the above (1), wherein the single-sheet processing machine has a single-sheet processing carry-in unit for receiving a sheet conveyed from the image forming apparatus body and a single-sheet processing carry-out unit for discharging the sheet to any other postprocessing unit, wherein the single-sheet processing machine is directly attached to the image forming apparatus body without intervention of any other postprocessing unit.

Thereby, the single-sheet processing machine is attached to the image forming apparatus body with other postprocessing units appropriately arranged on the downstream side of the single-sheet processing machine in the sheet conveying direction. Therefore, it is possible to perform various postprocessing using other postprocessing units also for sheets processed with the single-sheet processing.

(5) The image forming system according to the above (1), wherein the single-sheet processing machine has a punching unit for punching sheet in units of a sheet and a folding unit for folding sheet in units of a sheet, the folding unit arranged on the downstream side of the punching unit in the sheet conveying direction.

This enables punching for unfolded sheets, thereby increasing an accuracy of the punched position on the sheets. More specifically, it is hard to form a fold having no slope on a sheet in the fold processing. Therefore, for example, if alignment is made with reference to a fold before punching a folded sheet, it has been often the case that the punched area of the sheet is inclined with the slope of the sheet around the fold. The configuration of the present invention, however, enables punching with a high accuracy of position and free from inclination, independently of whether there is a slope of a sheet around a fold.

(6) The image forming system according to the above (1), wherein the single-sheet processing machine comprises a single-sheet processing carry-in unit for receiving a sheet conveyed from the image forming apparatus body, a single-sheet processing carry-out unit for discharging the sheet to any other postprocessing unit, a first processing unit for postprocessing sheet in units of a sheet, a second processing unit for postprocessing sheet in units of a sheet, the second processing unit arranged on the downstream side of the first processing unit in the sheet conveying direction, a first conveying path for conveying the sheet received by the single-sheet processing carry-in unit to the single-sheet processing carry-out unit without intervention of the first processing unit and the second processing unit, a second conveying path for conveying the sheet received by the single-sheet processing carry-in unit to the first processing unit, a third conveying path for conveying the sheet from the first processing unit to the second processing unit, and a fourth conveying path for conveying the sheet from the second processing unit to the first conveying path.

Thereby, the sheet received by the single-sheet processing carry-in unit is returned to the first conveying path and then conveyed to the single-sheet processing carry-out unit, independently of whether it is to be postprocessed in some processing unit. Therefore, in the image forming system in which other postprocessing units can be selectively attached, it becomes possible to simplify a paper carry-out route on the side of the image forming apparatus body or any other postprocessing units feeding paper to the single-sheet processing carry-in unit or the paper carry-in route on the side of other postprocessing units to which paper is fed from the single-sheet processing carry-out unit.

(7) The image forming system according to the above (6), wherein, in the single-sheet processing machine, the third conveying path includes a third A conveying path for conveying a sheet having a length no more than a predetermined length in the sheet feeding direction to the second processing unit and a third B conveying path for conveying a sheet having a length more than the predetermined length in the sheet feeding direction to the second processing unit.

Thereby, it becomes possible to provide the third A conveying path as a shortcut route up to the second processing unit to use the third A conveying path and the third B conveying path appropriately according to the length of a sheet in the feeding direction, thereby enhancing productivity of the postprocessing for sheets each having a length less than or equal to the given length in the sheet feeding direction.

To use the third A conveying path and the third B conveying path appropriately, a direction of a flapper provided at a junction of the second conveying path and the third A conveying path is controlled based on information input from an operation panel provided in the image forming apparatus body so as to feed a sheet to one of the conveying paths.

(8) The image forming system according to the above (6), wherein the single-sheet processing machine has a sheet attachment unit for placing cover sheets or insert sheets attached by the sheet attachment function and a fifth conveying path for conveying the cover sheets or the insert sheets from the sheet attachment unit to the first conveying path.

Thereby, the cover sheets or the insert sheets fed from the sheet attachment unit are conveyed to the first conveying path via the fifth conveying path. Thus, it becomes possible to share the subsequent conveying paths merged into the first conveying path, thereby enabling simplification of the conveying paths and downsizing of the single-sheet processing machine, thereby downsizing the entire image forming system.

(9) The image forming system according to the above (8), wherein the single-sheet processing machine has a branching portion where the conveying path branches out into the first conveying path and the second conveying path on the downstream side of the single-sheet processing carry-in unit in the sheet conveying direction and a merging portion where the fifth conveying path joins the first conveying path on the upstream side of the branching portion in the sheet conveying direction.

Thereby, the cover sheets or the insert sheets carried from the sheet attachment unit can be postprocessed in the first processing unit and the second processing unit, too.

(10) The image forming system according to the above (6), wherein the single-sheet processing machine has a single-sheet processing discharge unit for discharging remaining sheets in the image forming system at an occurrence of a sheet jam or a test-recorded sheet for use in checking an image recording condition and a sixth conveying path for conveying sheets from the first conveying path to the single-sheet processing discharge unit.

This enables discharging the remaining sheets in the image forming system to the single-sheet processing discharge unit at the occurrence of a sheet jam, thus enhancing a capability to handle a sheet jam. Furthermore, in a condition where a plurality of postprocessing units are attached on the downstream side of the single-sheet processing machine in the sheet conveying direction, it is possible to discharge remaining sheets up to the single-sheet processing machine at an occurrence of a sheet jam to the single-sheet processing discharge unit.

Therefore, it is possible to decrease a period of time required for handling a sheet jam in comparison with a case of, for example, discharging remaining sheets to a discharge unit of a postprocessing unit located on the most downstream side.

Additionally, with a system arrangement where only one test-recorded sheet is discharged to the single-sheet processing discharge unit before recording of the predetermined number of sheets, the recording condition can be checked at the location of the single-sheet processing machine.

Furthermore, with a plurality of postprocessing units attached on the downstream side of the single-sheet processing machine in the sheet conveying direction, the system can be arranged in such a way as to discharge a test-recorded sheet to the single-sheet processing discharge unit located on the upstream side. Therefore, it is possible to decrease a period of time required for checking an image condition by means of test recording.

The single-sheet processing discharge unit differs from a normal discharge unit in which sheets are discharged to the outside of the single-sheet processing machine via the single-sheet processing carry-out unit. The single-sheet processing discharge unit satisfies either or both of a function as a discharge unit where remaining sheets are discharged at an occurrence of a sheet jam and a function as a discharge unit where a test-recorded sheet is discharged.

(11) The image forming system, further comprising an edge stapling machine, which is one of the plurality of types of postprocessing units, for binding a sheet bulk made of a plurality of sheets at an edge thereof, wherein the edge stapling machine has an edge stapling carry-in unit for receiving sheets conveyed from the image forming apparatus body or from any other postprocessing unit and wherein, if the single-sheet processing machine and the edge stapling machine are selectively attached, the edge stapling machine is attached on the downstream side of the single-sheet processing machine in the sheet conveying direction.

This enables edge binding of a sheet bulk made of sheets postprocessed in units of a sheet by using the single-sheet processing machine.

(12) The image forming system according to the above (11), wherein the edge stapling machine has at least one of stapling, tape binder, and pasting functions for the edge binding of the sheet bulk.

This enables the edge binding of the sheet bulk with at least one of the binding functions.

(13) The image forming system according to the above (11), wherein the edge stapling machine has an open discharge unit for discharging the sheet bulk made of a plurality of bound sheets at the side of the image forming apparatus and it is attachable in the most downstream of the image forming system in the sheet conveying direction.

This facilitates getting out sheets discharged from the open discharge unit provided. In addition, an enough space can be secured for the open discharge unit, thereby enabling a use of an open discharge unit having a large capacity. For example, it is possible to have an open discharge unit moving up and down according to a required capacity.

(14) The image forming system according to the above (11), wherein the edge stapling machine has an edge stapling discharge unit for discharging remaining sheets in the image forming system at an occurrence of a sheet jam or a test-recorded sheet for use in checking an image recording condition.

This enables discharging the remaining sheets in the image forming system to the edge stapling discharge unit at the occurrence of a sheet jam, thus enhancing a capability to handle a paper jam.

In addition, it is possible to check a recording condition at the location of the edge stapling machine with an arrangement in which only one test-recorded sheet is discharged to the edge stapling discharge unit before recording of all the predetermined number of sheets.

The edge stapling discharge unit differs from a normal discharge unit for discharging sheets to the outside of the edge stapling machine via an edge stapling carry-out unit.

Furthermore, the edge stapling discharge unit satisfies either or both of a function as a discharge unit where remaining sheets are discharged at an occurrence of a sheet jam and a function as a discharge unit where a test-recorded sheet is discharged.

(15) The image forming system according to the above (1), further comprising a center stitching machine, which is one of the plurality of types of postprocessing units, for folding and stitching a paper bulk made of a plurality of sheets, wherein the center stitching machine has a center stitching carry-in unit for receiving sheets conveyed from any other postprocessing unit attached on the upstream side in the sheet conveying direction and a center stitching carry-out unit for conveying sheets to any other postprocessing unit attached on the downstream side in the sheet conveying direction and wherein, if the single-sheet processing machine and the center stitching machine are selectively attached, the center stitching machine is attached on the downstream side of the single-sheet processing machine in the sheet conveying direction.

This enables the fold and stitch processing also for a sheet bulk made of sheets postprocessed in units of a sheet by using the single-sheet processing machine, too.

(16) The image forming system according to the above (15), wherein the center stitching machine has a stapling function for folding and stitching the paper bulk.

This enables the paper bulk to be folded and stitched with stapling.

(17) The image forming system according to the above (15), wherein the center stitching machine has a paper cutting function for cutting a sheet bulk made of a plurality of sheets.

This enables edge cutting of the sheet bulk bound with center stitching, thereby achieving even-edge bookbinding with center stitching.

(18) The image forming system according to the above (15), wherein the center stitching machine has a center stitching discharge unit for discharging remaining sheets in the image forming system at an occurrence of a sheet jam or a test-recorded sheet for use in checking an image recording condition.

This enables discharging the remaining sheets in the image forming system to the center stitching discharge unit at the occurrence of a paper jam, thus enhancing a capability to handle a paper jam.

In addition, it is possible to check a recording condition at the location of the center stitching machine with an arrangement in which only one test-recorded sheet is discharged to the center stitching discharge unit before recording of all the predetermined number of sheets.

The center stitching discharge unit differs from a normal discharge unit for discharging sheets to the outside of the center stitching machine via a center stitching carry-out unit.

Furthermore, the center stitching discharge unit satisfies either or both of a function as a discharge unit where remaining sheets are discharged at an occurrence of a sheet jam and a function as a discharge unit where a test-recorded sheet is discharged.

(19) The image forming system according to the above (15), wherein the center stitching machine has a center-stitched paper stacking unit where a center-stitched sheet bulk is placed and which is movable relative to the center stitching machine body.

This causes the center-stitched paper bulk to be placed on the center-stitched paper stacking unit movable relative to the center stitching machine body, thereby facilitating handling of the sheet bulk after the center stitching. The center-stitched paper stacking unit includes one having a structure such that, for example, a stacking part can be pulled out of a center stitching machine body or that it is detachable therefrom. Furthermore, as a detachable structure, there can be, for example, a bucket-type structure that a bucket can be detached after pulling out a pullout portion, besides a wagon-type structure.

(20) The image forming system according to the above (1), further comprising a case binding machine, which is one of the plurality of types of postprocessing units, for case-binding a sheet bulk made of a plurality of sheets with a cover sheet, wherein, if the single-sheet processing machine and the case binding machine are selectively attached, the case binding machine is attached on the downstream side of the single-sheet processing machine in the sheet conveying direction.

This enables case binding of the sheet bulk with the cover sheet.

(21) The image forming system according to the above (20), wherein the case binding machine has a pasting function of pasting the sheet bulk or a stapling function of binding the sheet bulk.

Thereby, a sheet bulk to be case-bound can be pasted or stapled.

(22) The image forming system according to the above (20), wherein the case binding machine has a case-bound paper cutting function of cutting the case-bound paper bulk.

This enables edge cutting of the case-bound paper bulk, thereby achieving even-edge case binding.

(23) The image forming system according to the above (20), wherein the case binding machine has a case binding discharge unit for discharging remaining sheet in the image forming system at an occurrence of a sheet jam or a test-recorded sheet for use in checking an image recording condition.

This enables discharging the remaining sheets in the image forming system to the case binding discharge unit at the occurrence of a sheet jam, thus enhancing a capability to handle a sheet jam.

In addition, it is possible to check a recording condition at the location of the case binding machine with an arrangement in which only one test-recorded sheet is discharged to the case binding discharge unit before recording of all the predetermined number of sheets.

The case binding discharge unit differs from a normal discharge unit for discharging sheets to the outside of the case binding machine via a case binding carry-out unit.

Furthermore, the case binding discharge unit satisfies either or both of a function as a discharge unit where remaining sheets are discharged at an occurrence of a sheet jam and a function as a discharge unit where a test-recorded sheet is discharged.

(24) The image forming system according to the above (20), wherein the case binding machine has a case-bound sheet stacking unit where a case-bound sheet bulk is placed and which is movable relative to the case binding machine body.

This causes the case-bound sheet bulk to be placed on the case-bound sheet stacking unit movable relative to the case binding machine body, thereby facilitating handling of the sheet bulk after the case binding. The case-bound sheet stacking unit includes one having a structure such that, for example, a stacking part can be pulled out of a case binding machine body or that it is detachable therefrom.

Furthermore, as a detachable structure, there can be, for example, a bucket-type structure that a bucket can be detached after pulling out a pullout portion, besides a wagon-type structure.

(25) The image forming system according to the above (1), further comprising a high-volume stacker, which is one of the plurality of types of postprocessing units and which can accommodate a large quantity of output sheet, wherein the high-volume stacker has a detachable high-volume stacking unit where a large quantity of output sheet is stacked and which is detachable from a high-volume stacker body, a high-volume stacking carry-in unit for receiving sheets conveyed from the image forming apparatus body or any other postprocessing unit attached on the upstream side in the sheet conveying direction, and a high-volume stacking carry-out unit for conveying the sheets to any other postprocessing unit attached on the downstream side in the sheet conveying direction.

This causes the large quantity of output sheet to be stacked on the detachable high-volume stacking unit, which can be detached from the high-volume stacker, thereby facilitating handling of a large quantity of output paper. Furthermore, as a structure of the detachable high-volume stacking unit, there can be, for example, a bucket-type structure that a bucket can be detached after pulling out a pullout portion, besides a wagon-type structure.

(26) The image forming system according to the above (25), wherein the high-volume stacker has a high-volume stacking discharge unit for discharging remaining sheets in the image forming system at an occurrence of a sheet jam or a test-recorded sheet for use in checking an image recording condition.

This enables discharging the remaining sheets in the image forming system to the high-volume stacking-discharge unit at the occurrence of a sheet jam, thereby enhancing a capability to handle a sheet jam.

In addition, it is possible to check a recording condition at the location of the high-volume stacker with an arrangement in which only one test-recorded sheet is discharged to the high-volume stacking discharge unit before recording of all the predetermined number of sheets.

The high-volume stacking discharge unit satisfies either or both of a function as a discharge unit where remaining sheets are discharged at an occurrence of a sheet jam and a function as a discharge unit where a test-recorded sheet is discharged.

(27) The image forming system according to the above (1), wherein all of the plurality of types of postprocessing units have their discharge units for discharging remaining sheets in the image forming system at an occurrence of a sheet jam or a test-recorded sheet for use in checking an image recording condition.

This enables discharging the remaining sheets in the image forming system to the respective discharge units at the occurrence of a sheet jam. Thereby, each of the remaining sheets can be discharged to the closest discharge unit on the downstream side in the sheet conveying direction, thus enhancing a capability to handle a sheet jam.

In addition, it is possible to check a recording condition at the location of one of the postprocessing units with an arrangement in which only one test-recorded sheet is discharged to one of the discharge units before recording of all the predetermined number of sheets.

The respective discharge units differ from normal discharge units for discharging sheets postprocessed by the respective postprocessing units. Furthermore, each of them satisfies either or both of a function as a discharge unit where remaining sheets are discharged at an occurrence of a sheet jam and a function as a discharge unit where a test-recorded sheet is discharged.

(28) An image forming system, comprising an image forming apparatus body and at least one postprocessing unit attached thereto selectively from a plurality of types of attachable postprocessing units, wherein at least one postprocessing unit is a single-sheet processing machine for postprocessing sheet in units of a sheet, which is attached at the most upstream location of other postprocessing units in the sheet conveying direction, and wherein the single-sheet processing machine has at least one type of single-sheet processing function for postprocessing paper in units of a sheet and a sheet attachment function for attaching a cover sheet or an insert sheet to an output sheet bulk.

This enables other postprocessing units to be selectively attached on the downstream side of the single-sheet processing machine in the sheet conveying direction appropriately, by which other postprocessing units can perform various postprocessing for sheets processed with the single-sheet processing.

(29) The image forming system, wherein the single-sheet processing machine has a fold function for folding two or more sheets at a time.

This enables simultaneous folding of two or more sheets with the single-sheet processing machine, thereby improving productivity in fold processing.

BRIEF DESCRIPTION OF THE DRAWINGS

FIG. 6A is a front view showing a processing route of a sheet S during foldout processing; FIGS. 6B, 6C, 6D, 6E, 6F, and 6G are pattern diagrams of foldout processing steps; and FIG. 6H is a perspective view of the foldout sheet;

DETAILED DESCRIPTION OF THE PREFERRED EMBODIMENTS

The preferred embodiments of a postprocessing system according to the present invention will now be described in detail hereinafter with reference to the accompanying drawings.

[Image Forming System]

Figure 1:
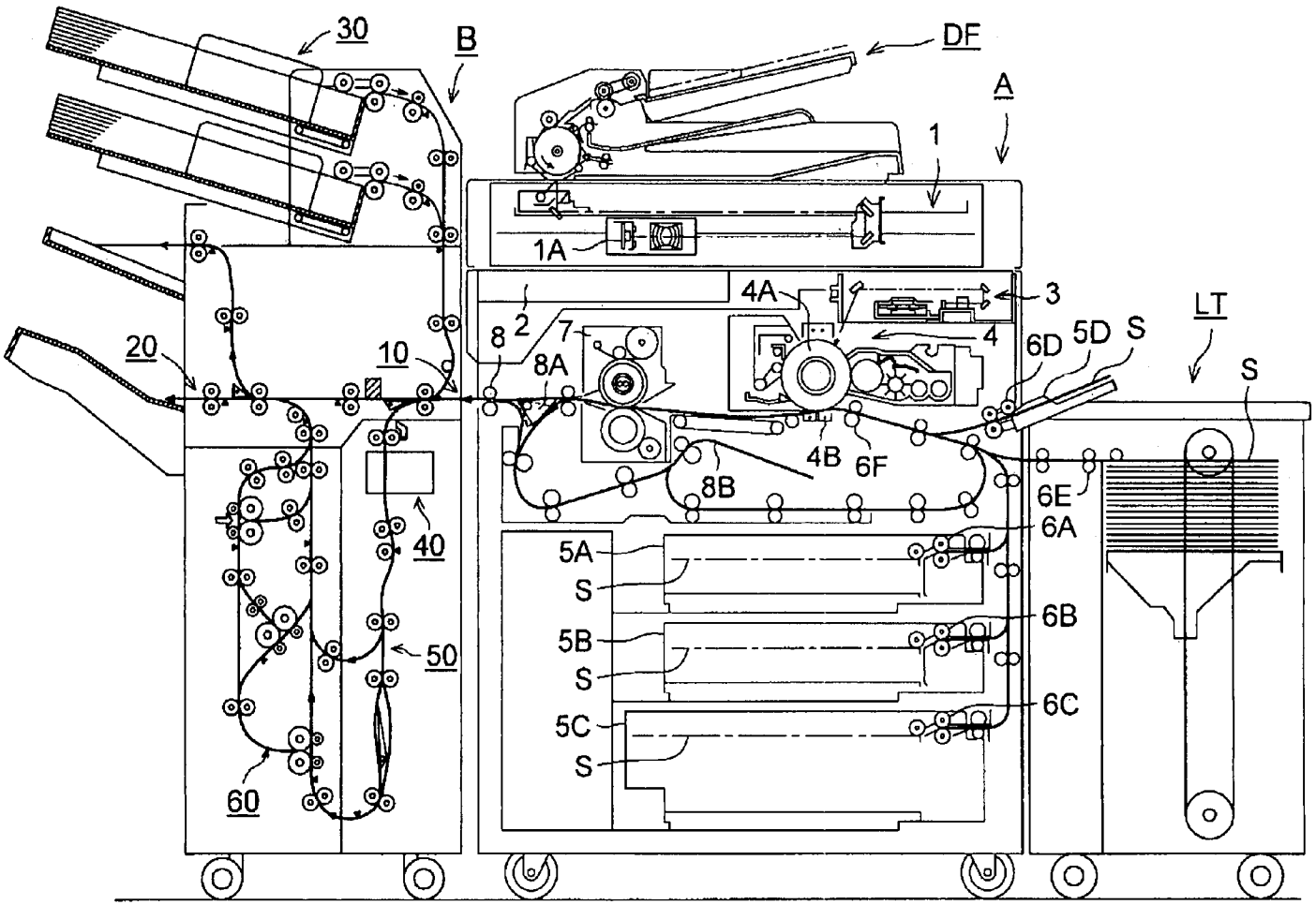
FIG. 1 is a general configuration diagram of an image forming system comprising an image forming apparatus, an automatic document feeder, a single-sheet processing machine, and a high-volume feeder.

Referring to FIG. 1, there is shown a general configuration diagram of an image forming system comprising of an image forming apparatus body A, an automatic document feeder DF, a single-sheet processing machine (postprocessing unit) B, and a high-volume feeder LT.

The image forming apparatus body A shown here has an image reading unit (image input unit) 1, an image processing unit 2, an image writing unit 3, an image forming unit 4, paper cassettes 5A, 5B, and 5C, a manual paper feed tray 5D, first paper feeding units 6A, 6B, 6C, and 6D, a second paper feeding unit 6F, a fixing unit 7, a paper discharge unit 8, and an automatic double-sided copy feeding unit (ADU) 8B.

The automatic document feeder DF is mounted on the image forming apparatus body A at the top thereof. The single-sheet processing machine (postprocessing unit) B is connected to the image forming apparatus body A on the side of the paper discharge unit 8, as shown in the left side of the image forming apparatus body A.

A document d placed on a platen of the automatic document feeder DF is conveyed in a direction indicated by an arrow. An optical system of the image reading unit 1 reads an image on a single side or both sides of the document and an image sensor CCD reads the image.

The image processing unit 2 performs analog processing, an A/D conversion, a shading correction, image compression, or the like for an analog signal photoelectrically converted by the image sensor CCD. Thereafter, the signal is transmitted to the image writing unit 3.

In the image writing unit 3, a photosensitive drum 4A of the image forming unit 4 is irradiated with an output light from a semiconductor laser so as to form a latent image. The image forming unit 4 performs static electrification, exposure, development, transfer, separation, cleaning, and other processing. An image on a sheet S fed from the paper cassettes 5A to 5C, the manual paper feed tray 5D, or the high-volume feeder LT by the first paper feeding units 6A to 6E is transferred to the sheet S by a transferring means 4B. The image carried by the sheet S is fixed by the fixing unit 7 and the sheet S is fed from the paper discharge unit 8 to the single-sheet processing machine B. Otherwise, a sheet image-processed on its single side and fed into the automatic double-sided copy feeding unit 8B by means of a conveying path switching flapper 8A is image-processed again so that image processing is performed on both sides in the image forming unit 4 and then discharged from the paper discharge unit 8.

[Single-Sheet Processing Machine]

The single-sheet processing machine B comprises a single-sheet processing carry-in unit 10, a single-sheet processing carry-out unit 20, a sheet attachment unit (cover sheet feeding unit) 30, a punching unit (a first processing unit) 40, a conveying unit 50, and a folding unit (a second processing unit) 60.

Figure 2:
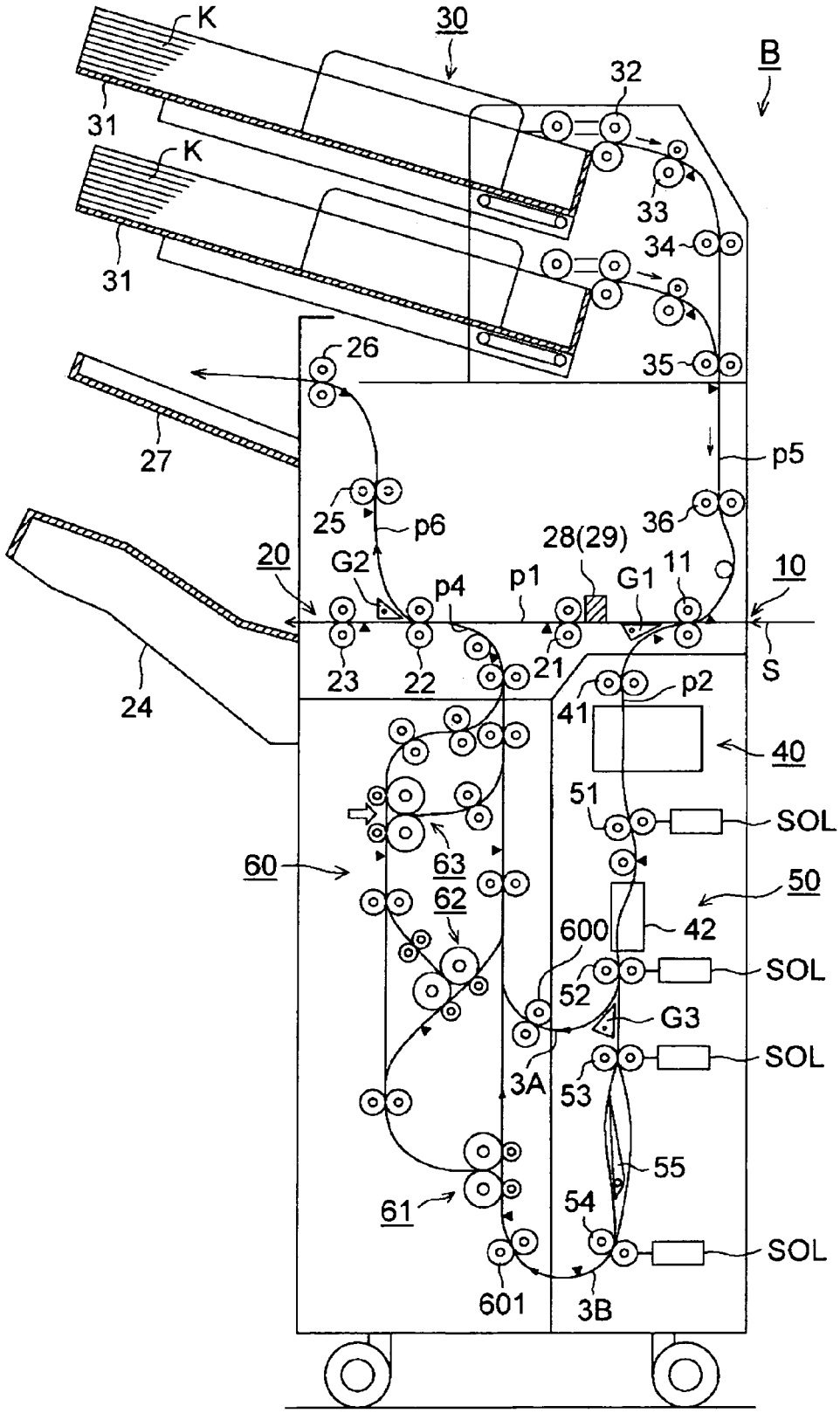
FIG. 2 is a general configuration diagram of a single-sheet processing machine according to the present invention.

Referring to FIG. 2, there is shown a general configuration diagram of the single-sheet processing machine B according to the present invention.

<Single-Sheet Processing Carry-In Unit>

The image-formed sheets S are introduced from the image forming apparatus body A to the single-sheet processing carry-in unit 10.

The position in which the recorded sheets are introduced in the single-sheet processing carry-in unit 10 is opposing to a position in which the recorded sheets are discharged in the paper discharge unit 8 of the image forming apparatus body A.

The recorded sheets S introduced into an inlet roller 11 are conveyed to one of the single-sheet processing carry-out unit 20 and the punching unit 40 by means of a conveying path switching means G1 (selection unit).

<Single-Sheet Processing Carry-Out Unit>

Without setting of the punching and folding processing, the conveying path switching means G1 blocks off a conveying path leading to the punching unit 40 and releases a conveying path leading to the single-sheet processing carry-out unit 20.

Recorded sheets S passing through a first conveying path p1 leading to the single-sheet processing carry-out unit 20 are conveyed straight while being sandwiched between conveying rollers 21 and conveying rollers 22 and discharged from the single-sheet processing carry-out unit 20 by means of discharging rollers 23. Thereafter, they are stacked on a main discharge tray 24, which is movable up and down. A maximum of 2,000 recorded sheets S and cover sheets K can be stacked on the main discharge tray 24.

The recorded sheets S switched by a conveying path switching means G2 to an upper portion of the diagram on the downstream side of the conveying rollers 22 in the sheet conveying direction pass through conveying rollers 25 on a sixth conveying path p6. The sheets S are ejected by discharging rollers 26 and stacked on a sub-discharge tray (top tray) 27 as a single-sheet processing discharge unit arranged in an upper portion of the single-sheet processing machine B. The sub-discharge tray 27 accommodates recorded sheets with an image formed as a trial or recorded sheets ejected after handling a sheet jam (single-sheet processing discharge unit).

<Sheet-Attachment Unit 30>

The cover sheets K or insert sheets on a paper feed tray 31 of a sheet attachment unit 30 are separated and fed by a paper feeding means 32 being sandwiched between respective conveying rollers 33, 34, 35, and 36 in the fifth conveying path p5. The sheets then merge into a conveying path on the upstream side of the branching portion (merging portion).

The paper feed trays 31 of the sheet attachment unit 30 are arranged vertically in two stages. Each of the paper feed trays 31 can accommodate a maximum of 500 cover sheets K or insert sheets.

It is also possible to perform punching or folding processing offline without activating image recording, by charging the sheet attachment unit 30 with cover sheets K, insert sheets, and recorded sheets S.

Hereinafter, the recorded sheets S, the cover sheets K, and the insert sheets are collectively referred to as sheets S.

<Punching Unit 40>

A sheet S switched by the conveying path switching means G1 of the single-sheet processing carry-in unit 10 is sandwiched between conveying rollers 41 arranged in a lower portion of the conveying path switching means G1 and then conveyed to the punching unit (the first processing unit) 40 (the second conveying path p2).

An alignment means 42 is arranged in the conveying path on the downstream side of the punching unit 40 to align the sheet S in the paper width direction before punching.

A punching machine of the punching unit 40 comprises a punch driven by a driving means not shown and a dice mating with a cutting part of the punch. A punched sheet S is conveyed to a conveying unit 50 in a lower portion (punching function).

Referring to FIGS. 11A to 11F, there are shown perspective views of sheets S and booklets SA after various post-processing.

Figure 11A:
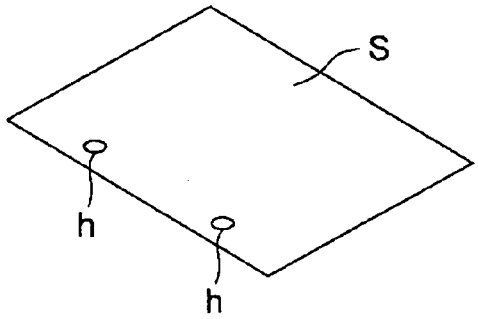
FIGS. 11A, 11B, 11C, 11D, 11E, and 11F are perspective views of sheets and booklets after various postprocessing.
Figure 11B:
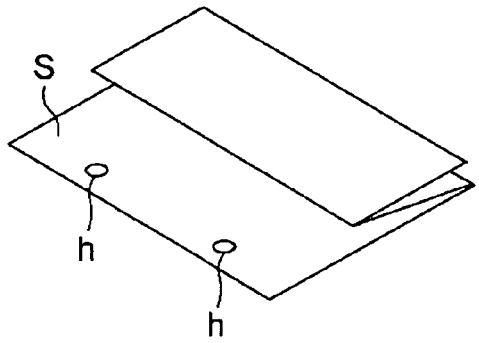

FIG. 11A shows a perspective view of a sheet S where holes h are made in the punching processing with the punching unit 40. FIG. 11B shows a perspective view of a sheet S foldout-processed after punching with the punching unit 40.

<Conveying Unit 50>

A sheet S conveyed to the conveying unit 50 is sandwiched between respective conveying rollers 51, 52, 53, and 54 and conveyed to the folding unit 60. The conveying rollers 51, 52, 53, and 54 are formed by a driving roller connected to a drive source and a follow-up roller put in contact against the driving roller with pressure. Each follow-up roller is connected to a solenoid SOL and it can be put in contact and separated from the driving roller.

Sheets S not to be folded among small-sized punched sheets S pass through a third A conveying path p3A switched by a conveying path switching means G3, and they are conveyed being sandwiched between conveying rollers 600. Large-sized punched sheets S are conveyed by conveying rollers 53 and conveying rollers 54 to a third B conveying path p3B in the lower portion of the branching position of the conveying path switching means G3 independently of whether they need be folded and are introduced to the folding unit 60. Note here that the third A conveying path p3A and the third B conveying path p3B form a third conveying path.

Two sheets can be folded at a time in the fold processing described later, by providing the conveying unit 50 with a conveying path switching means 55 and conveying two small-sized stacked sheets S. Naturally, there can be an arrangement such that sheets are folded in units of a sheet without a provision of the conveying path switching means 55.

<Folding Unit 60>

Figure 3:
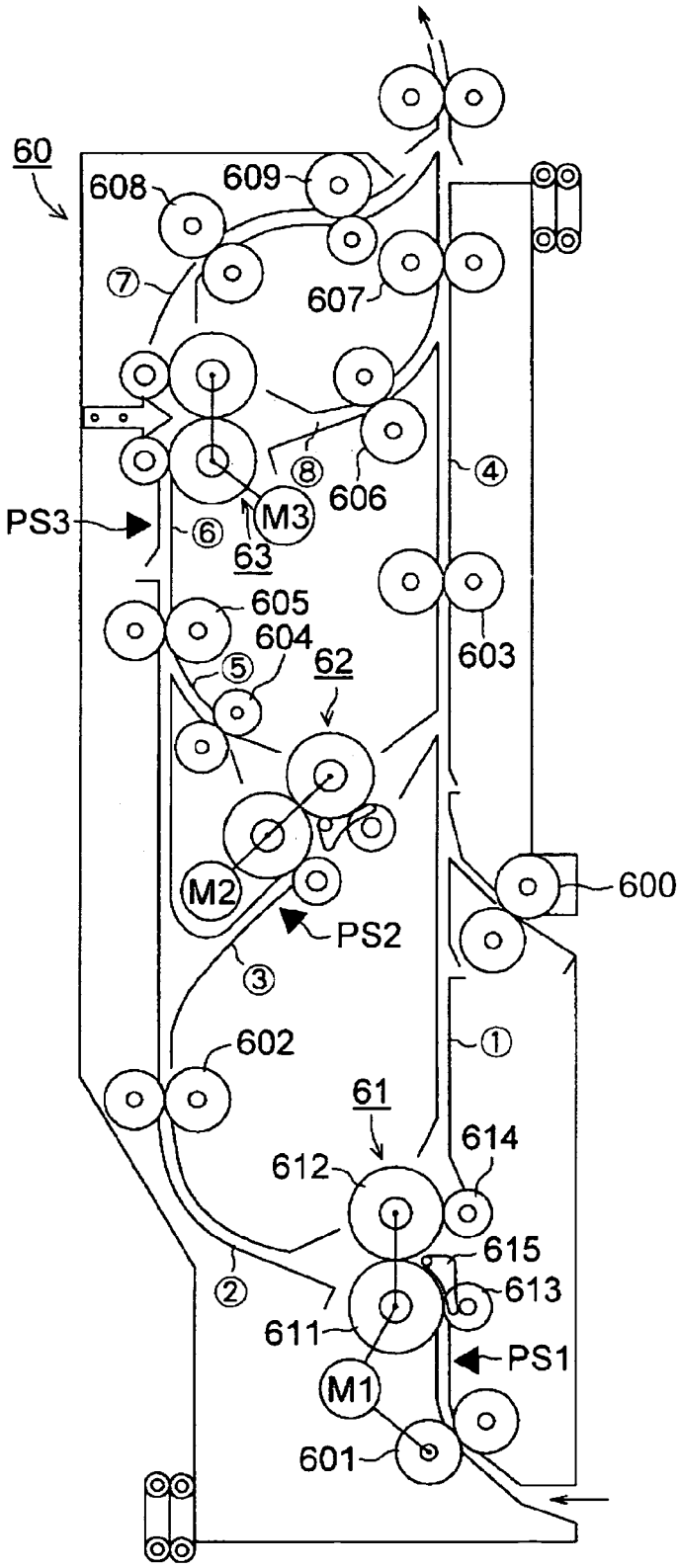
FIG. 3 is a cross section of a sheet folding unit.

The sheets S conveyed from the conveying unit 50 to the folding unit (the second processing unit) 60 are conveyed being sandwiched between registration rollers 601. Then, a first folding unit 61, a second folding unit 62, and a third folding unit 63 perform fold processing (folding functions) such as outward single fold, inward single fold, foldout, zig-zag, letter, inward quarto (hereinafter, also referred to as gate fold), and double parallel fold processing described later for the sheets. Thereafter, the sheets S are returned to the first conveying path p1 via a fourth conveying path p4. Referring to FIG. 3, there is shown a cross section of the folding unit 60.

The first folding unit 61 comprises a folding roller pair, which is formed by a folding roller 611 and a folding roller 612 and can be put in contact with pressure and be spaced therebetween, a folding conveying roller 613 in contact with the folding roller 611 with pressure, a folding conveying roller 614 in contact with the folding roller 612 with pressure, and a guide member 615 for tucking a fold of the sheet S into a sandwiched position of the folding roller pair.

The second folding unit 62 and the third folding unit 63 have almost the same configuration as the first folding unit 61. In the folding unit 60, there are arranged a plurality of conveying paths ①, ②, ③, ④, ⑤, ⑥, ⑦ and ⑧ and for connecting the first folding unit 61, the second folding unit 62, and the third folding unit 63 and a plurality of conveying rollers 602, 603, 604, 605, 606, 607, 608, and 609 for holding and conveying sheets S.

[Paper Fold Processing]

The folding unit 60 can perform seven types of fold processing such as double-spread outward single fold and inward single fold, triple-spread foldout, zig-zag, and letter fold, and quadruple-spread gate fold and double parallel fold. With setting of the fold processing function, a sheet S after fixing is halfway fed into the automatic double-sided copy feeding unit 8B and thereafter reversed and discharged from the image forming apparatus body A, by which it is ejected with an image surface t facing downward.

<Outward Single Fold Processing>

The first folding unit 61 performs the outward single fold processing in which a sheet S is folded with an image surface outward.

Figure 4A:
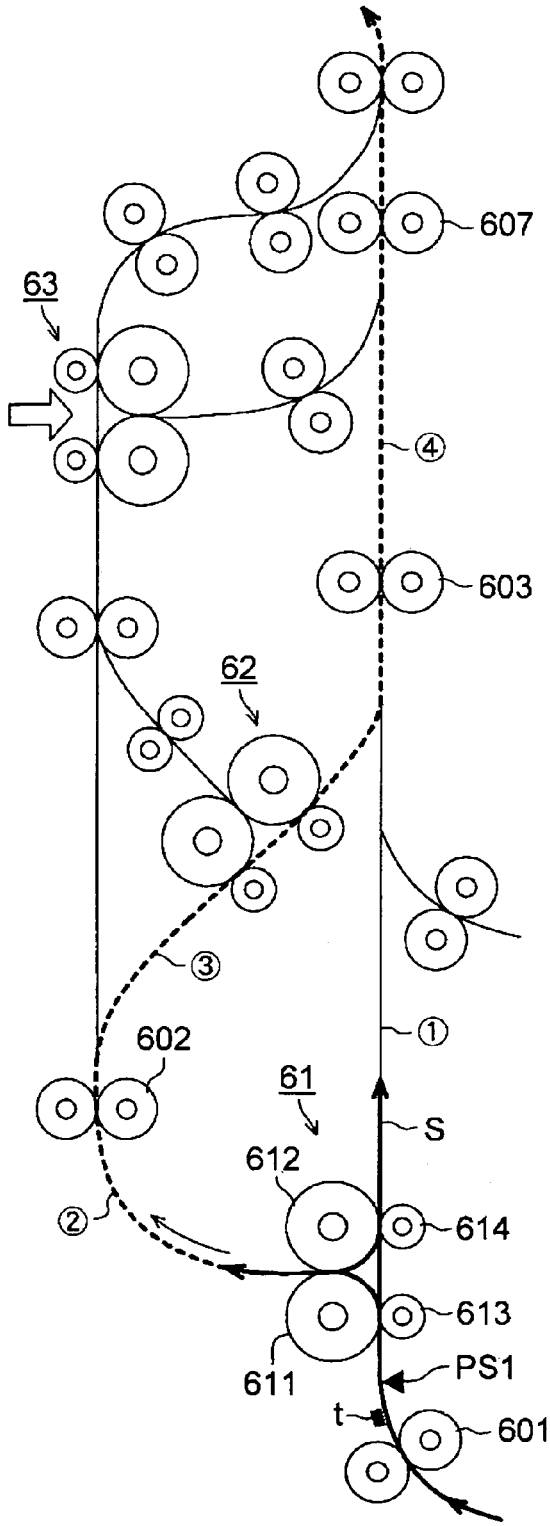
FIG. 4A is a front view showing a sheet processing route during outward single fold processing.
Figure 4B:
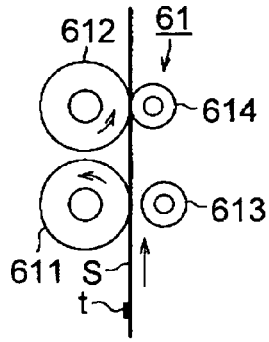
FIGS. 4B, 4C, and 4D are pattern diagrams of sheet outward single fold processing steps.
Figure 4C:
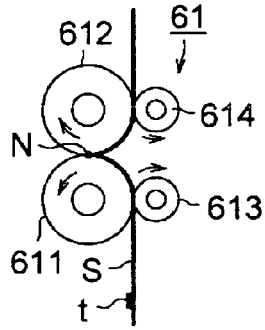
Figure 4D:
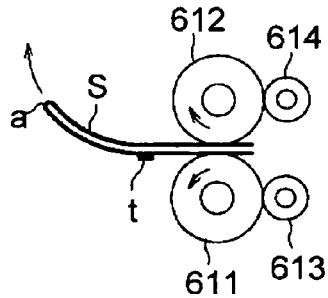
Figure 4E:
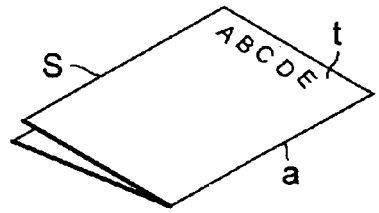
FIG. 4E is a perspective view of the folded sheet.

Referring to FIG. 4A, there is shown a front view of a processing route of a sheet S during the outward single fold processing. Referring to FIGS. 4B to 4D, there are shown pattern diagrams of processing steps of the outward single fold processing of the sheet S. Referring to FIG. 4E, there is shown a perspective view of the folded sheet S.

The following describes the processing steps of the single fold processing with the image surface outward.

(a) The sheet S, which is to be discharged from the image forming apparatus A with the image surface t facing downward (face down), passes through the single-sheet processing carry-in unit 10 of the single-sheet processing machine B and the conveying unit 50 and is introduced into the folding unit 60 being sandwiched between the registration rollers 601 with the image surface t facing downward.

A front end of the sheet S conveyed by the first folding unit 61 passes through a sandwiched position of a driven-rotating folding roller 611 and a folding conveying roller 613. It then goes straight on the conveying path ① while being conveyed and sandwiched between a driven-rotating folding roller 612 and a folding conveying roller 614. After a lapse of a given period of time since a sensor PS1 detected the passage of the front end of the sheet, the control means stops the driving of the folding rollers 611 and 612 and thereby the sheet S stops at a predetermined position.

Regarding the sheet stop position, the vicinity of the center of the sheet S in the conveying direction corresponds to the intermediate position between the folding roller 611 and the folding roller 612 (See FIG. 4B).

(b) With a start of driving a reverse rotation of the folding roller 612 and the folding conveying roller 614, the sheet S is tucked into a pressure contact position between the folding roller 611 and the folding roller 612 at one-half of a distance from the front end of the sheet S and pressed to form a fold a of the inward single fold processing (See FIGS. 4C and 4D).

(c) The sheet S with the single fold a is held by the driven folding rollers 611 and 612 and then it is discharged. Thereafter, the sheet S passes through the conveying paths ② and ③ with the fold a frontward and goes to the second folding unit 62.

(d) The sheet S whose single fold processing has been completed with the formation of the fold a is held by the driving conveying rollers 603 and 607 and passes through the conveying path ④, and it is then discharged. Thereafter, the sheet S is conveyed to the first conveying path p1 with the fold a frontward.

<Inward Single Fold Processing>

The third folding unit 63 performs the inward single fold processing of the sheet S with the image surface inward.

Figure 5A:
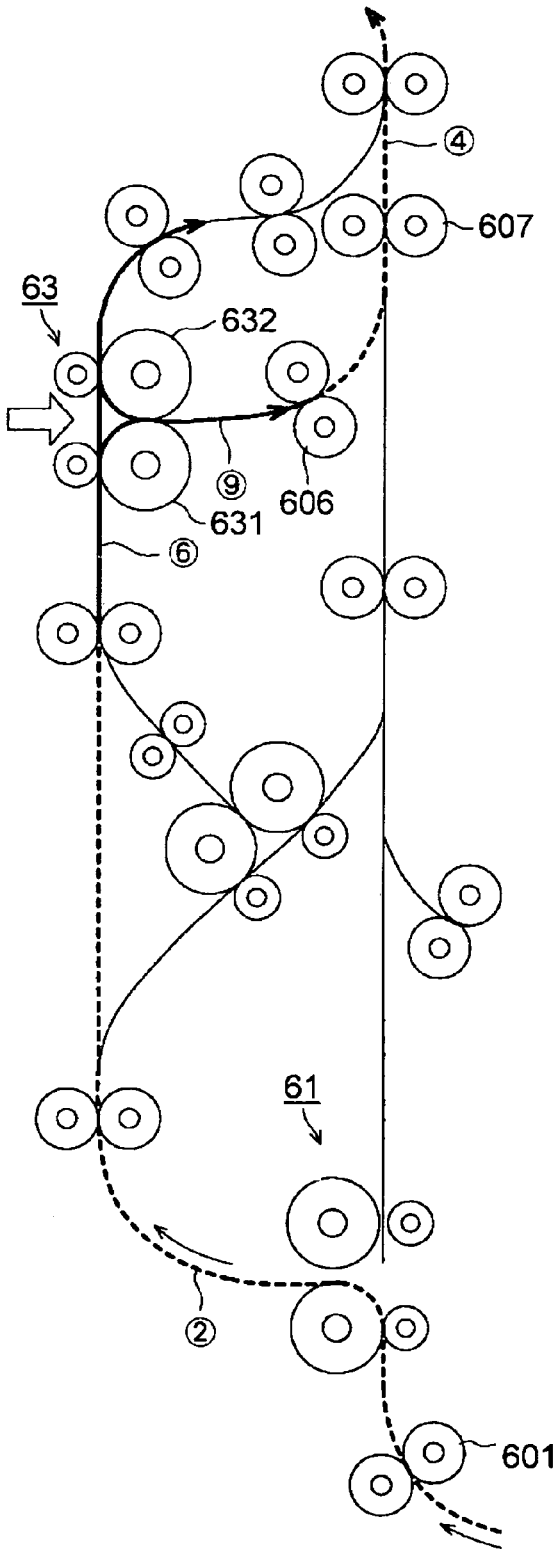
FIG. 5A is a front view showing a sheet processing route during inward single fold processing.
Figure 5B:
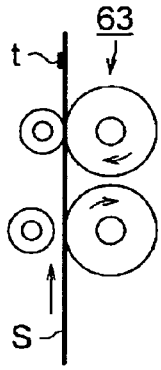
FIGS. 5B, 5C, 5D, and 5E are pattern diagrams of sheet inward single fold processing steps.
Figure 5C:
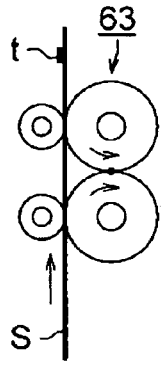
Figure 5D:
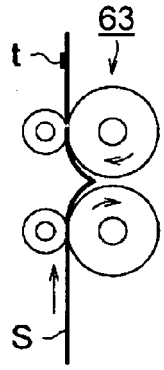
Figure 5E:
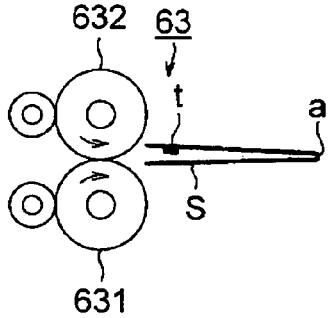
Figure 5F:
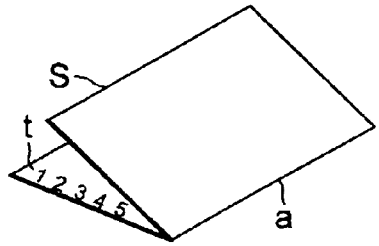
FIG. 5F is a perspective view of the folded sheet.

Referring to FIG. 5A, there is shown a front view of a processing route of the sheet S during the inward single fold processing. Referring to FIGS. 5B to 5E, there are shown pattern diagrams of inward single fold processing steps of the sheet S. Referring to FIG. 5F, there is shown a perspective view of the folded sheet S.

The sheet S introduced into the folding unit 60 passes through the first folding unit 61 without any processing and is conveyed to the third folding unit 63 via the conveying paths ② and ⑥. In the third folding unit 63, the sheet S single-folded with the image surface t inward by a folding roller 631 and a folding roller 632 passes through a conveying path ④ with the fold a frontward and is discharged to the first conveying path p1.

<Foldout Processing>

The foldout processing of a sheet S includes first fold processing of foldout processing in the first folding unit 61 and second fold processing of foldout processing in the third folding unit 63.

Referring to FIG. 6A, there is shown a front view of a processing route of the sheet S during the foldout processing. Referring to FIGS. 6B to 6G, there are shown pattern diagrams of the foldout processing steps in the first folding unit 61 and the third folding unit 63.

A front end of the sheet S conveyed by the first folding unit 61 with being sandwiched between the registration rollers 601 passes through an opposing position between the driven-rotating folding roller 611 and the folding conveying roller 613. It is then conveyed being sandwiched between the driven-rotating folding roller 612 and the folding conveying roller 614. After a lapse of a given period of time since the sensor PS1 has detected the passage of the front end of the sheet, the control means stops the driving of the folding rollers 611 and 612 and thereby the sheet S stops at a predetermined position. Regarding the sheet stop position, the front end of the sheet S is located forward of the opposing position between the folding roller 611 and the folding roller 612 by one-quarter of the entire length L of the sheet S in the conveying direction (See FIG. 6B).

With the contact of the folding roller 612 against the folding roller 611 with pressure and a start of driving a reverse rotation of the folding roller 612 and the folding conveying roller 614, the sheet S is tucked into a pressure contact position N between the folding roller 611 and the folding roller 612 at one-quarter of a distance from the front end of the sheet S and pressed to form a first fold b of the foldout processing (See FIG. 6C).

The sheet S with the first fold b of the foldout processing is sandwiched between the driven-rotating folding rollers 611 and 612 and then discharged. Thereafter, it moves to the third folding unit 63 with the first fold b frontward (See FIG. 6D).

The first fold b of the sheet S conveyed to the third folding unit 63 passes through the driven-rotating folding rollers 631 and 632. After a lapse of a given period of time since a sensor PS3 has detected the passage of the front end of the sheet, the control means 100 stops the driving of the folding roller pair and thereby the sheet S stops at a predetermined position. Regarding the sheet stop position, a distance between a rear end of the sheet S and the opposing position of the folding roller pair corresponds to one-half of the entire length L of the sheet S (See FIG. 6E).

With the contact of the folding roller pair with pressure and a start of driving a reverse rotation in the same manner as for the first folding unit 61, the sheet S is tucked into a pressure contact position between the folding roller 631 and the folding roller 632 at the center of the sheet S in the conveying direction and pressed to form a second fold c of the foldout processing (See FIG. 6F). In this formation, the front end of the sheet S reaches the pressure contact position of the folding rollers 631 and 632 first and then a curving portion to be the second fold c reaches the pressure contact position.

The sheet S whose foldout processing has been completed with the formation of the second fold c is sandwiched between the driven-rotating folding rollers 631 and 632 and the conveying rollers 606, and then it is discharged. Thereafter, it passes through the conveying path ④ with the second fold c frontward and is discharged to the first conveying path p1 (See FIG. 6G).

Referring to FIG. 6H, there is shown a perspective view of the foldout-processed sheet S. Reference characters b, c, and t designate the first fold, the second fold, and the image surface of the foldout-processed sheet S, respectively. The foldout-processed sheet S has a preferred form for file loading.

<Zig-Zag Fold Processing>

The zig-zag fold processing of a sheet S includes first fold processing in the first folding unit 61 and second fold processing in the second folding unit 62.

Figure 7A:
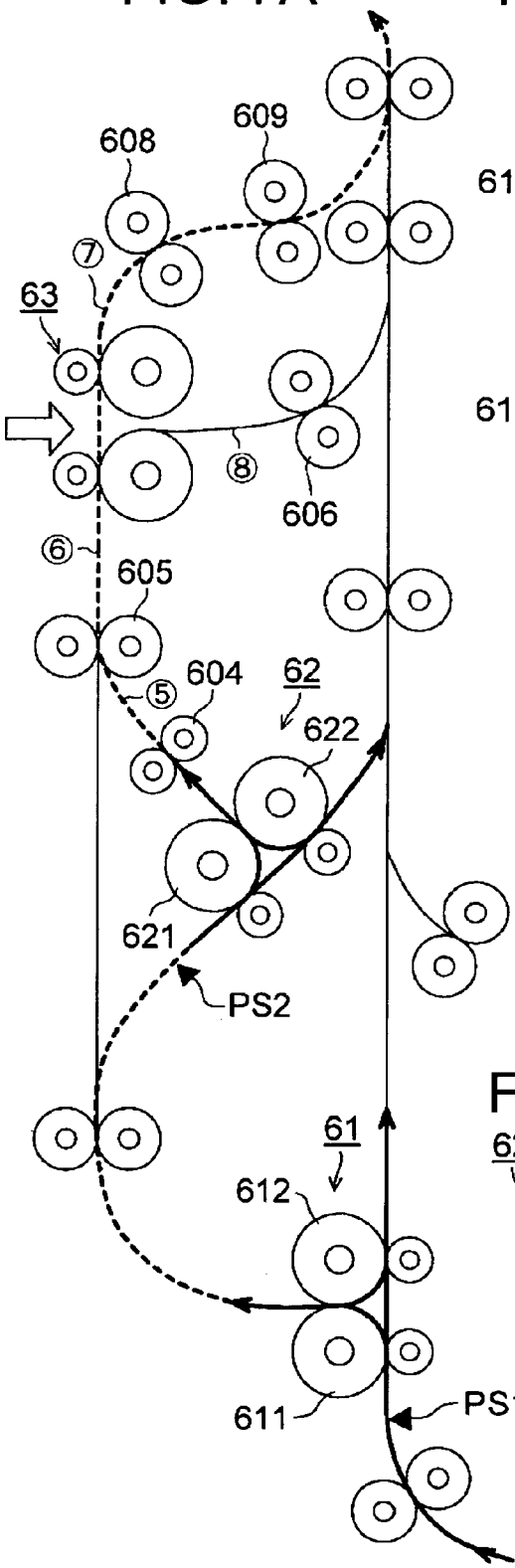
FIG. 7A is a front view showing a sheet processing route during zig-zag fold processing.
Figure 7B:
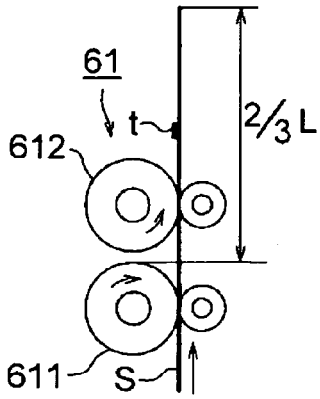
FIGS. 7B, 7C, 7D, 7E, 7F, and 7G are pattern diagrams of zig-zag fold processing steps.
Figure 7C:
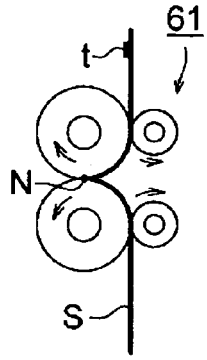
Figure 7D:
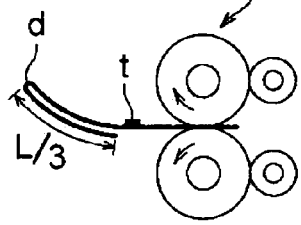
Figure 7E:
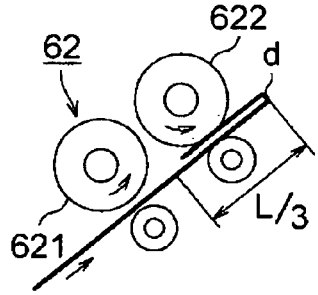
Figure 7F:
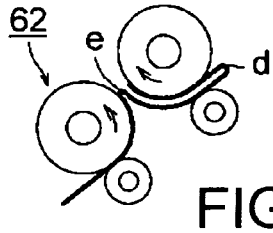
Figure 7G:
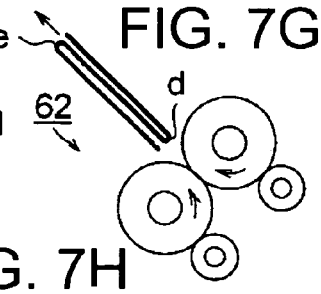

Referring to FIG. 7A, there is shown a front view of a processing route of the sheet S during the zig-zag fold processing. Referring to FIGS. 7B to 7G, there are shown pattern diagrams of zig-zag fold processing steps in the first folding unit 61 and the second folding unit 62.

After counting to a given number of pulses since a sensor PS2 has detected a passage of the front end of the conveyed sheet S in the first folding unit 61, the control means 100 stops the sheet S at a predetermined position.

The sheet S stops at the position where the front end of the sheet S is two-thirds of the entire sheet length L away from the opposing position of the folding roller pair. Thereafter, the folding rollers 611 and 612 perform the first fold processing to form a first fold d on the sheet S (See FIGS. 7B to 7D).

In the second folding unit 62, the sheet S stops at the position where the first fold d of the sheet S is one-third of the entire sheet length L away from the opposing position of folding rollers 621 and 622. Thereafter, the second fold processing is performed by means of the folding rollers 621 and 622 and thereby a second fold e is formed on the sheet S (See FIGS. 7E to 7G).

The sheet S whose zig-zag fold processing has been completed with the formation of the second fold e is sandwiched between the folding rollers 621 and 622 of the driven-rotating second folding unit 62 and the conveying rollers 604 and 605 and conveyed with the second fold e frontward. It then passes through the third folding unit 63 and is sandwiched between the conveying rollers 608 and 609 and discharged. Thereafter, the sheet S passes through the conveying path ④ with the second fold c frontward and is discharged to the first conveying path p1 (See FIG. 7A).

Figure 7H:
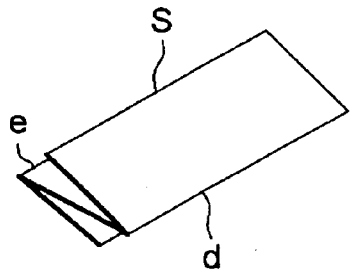
FIG. 7H is a perspective view of the zig-zag sheet.

Referring to FIG. 7H, there is shown a perspective view of the sheet S folded in zigzag form. Reference characters d, e, and t designate the first fold, the second fold, and the image surface of the sheet S folded in zigzag form, respectively.

<Letter Fold Processing>

The letter fold processing of a sheet S includes first fold processing in the first folding unit 61 and second fold processing in the second folding unit 62.

The sheet conveying route of the letter fold processing is the same as in the zig-zag fold processing. Therefore, a front view showing the processing route of the sheet S is omitted here.

Referring to FIGS. 8A to 8F, there are shown pattern diagrams of letter fold processing steps in the first folding unit 61 and the second folding unit 62.

In the letter fold processing, a stop position in the first folding unit 61 differs from that in the second folding unit 62.

In the first folding unit 61, the sheet S stops at the position where the front end of the sheet S is one-third of the entire sheet length L away from the opposing position of the folding rollers 611 and 612. Thereafter, the first fold processing is performed by means of the folding rollers 611 and 612 and thereby a first fold f is formed on the sheet S (See FIGS. 8A to 8C).

In the second folding unit 62, the sheet S stops at the position where the first fold f of the sheet S is one-third of the entire sheet length L away from the opposing position of the folding rollers 621 and 622. Thereafter, the second fold processing is performed by means of the folding rollers 621 and 622 and thereby a second fold g is formed on the sheet S (See FIGS. 8D to 8F).

Figure 8A:
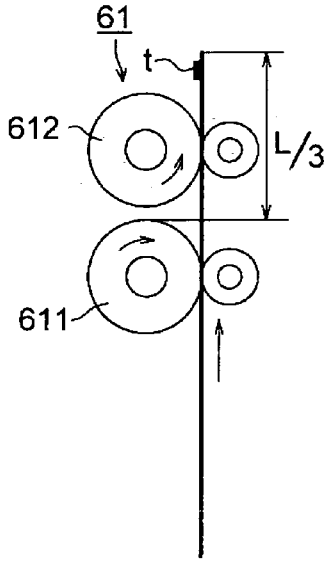
FIGS. 8A, 8B, 8C, 8D, 8E, and 8F are pattern diagrams of letter fold processing steps.
Figure 8B:
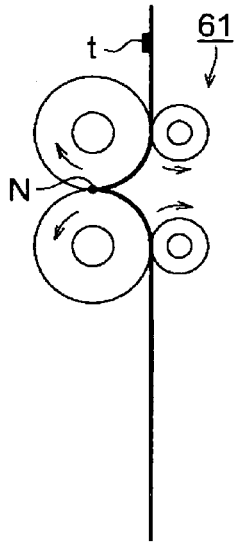
Figure 8C:
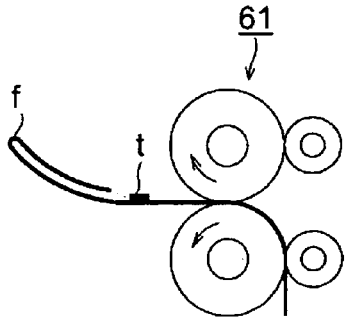
Figure 8D:
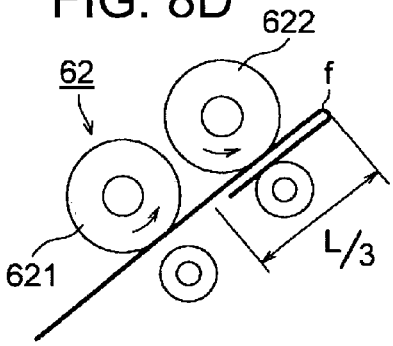
Figure 8E:
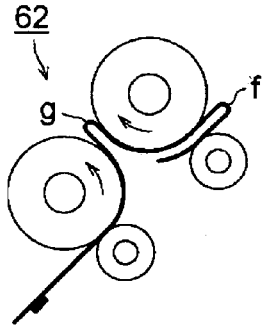
Figure 8F:
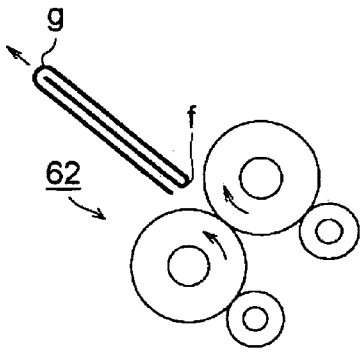
Figure 8G:
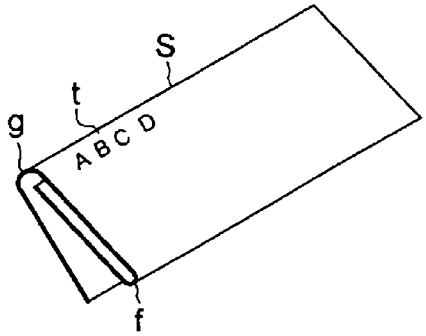
FIG. 8G is a perspective view of the letter-folded sheet.

Referring to FIG. 8G, there is shown a perspective view of the letter-folded sheet S. Reference characters f, g, and t designate the first fold, the second fold, and the image surface of the letter-folded sheet S, respectively.

<Double Parallel Fold Processing>

The double parallel fold processing of a sheet S includes first fold processing in the first folding unit 61 and second fold processing in the second folding unit 62.

The sheet conveying route of the double parallel fold processing is the same as in the zig-zag fold processing. Therefore, a front view showing the processing route of the sheet S is omitted here.

Referring to FIGS. 9A to 9F, there are shown pattern diagrams of double parallel fold processing steps in the first folding unit 61 and the second folding unit 62.

In the double parallel fold processing, the stop position of the sheet S differs from those in the zig-zag fold processing and in the letter fold processing, though the sheet conveying route is the same as those of the processing.

In the first folding unit 61, the sheet S stops at the position where the front end of the sheet S is one-half of the entire sheet length L away from the opposing position of the folding rollers 611 and 612. Thereafter, the first fold processing is performed by means of the folding rollers 611 and 612 and thereby a first fold h is formed on the sheet S (See FIGS. 9A to 9C).

In the second folding unit 62, the sheet S stops at the position where the first fold h of the sheet S is one-quarter of the entire sheet length L away from the opposing position of the folding rollers 621 and 622. Thereafter, the second fold processing is performed by means of the folding rollers 621 and 622, and thereby a second fold i inward and a third fold j outward are formed simultaneously on the sheet S (See FIGS. 9D to 9F).

Figure 9A:
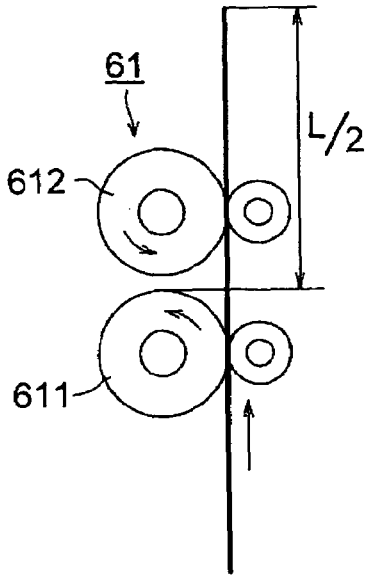
FIGS. 9A, 9B, 9C, 9D, 9E, and 9F are pattern diagrams of double parallel fold processing steps.
Figure 9B:
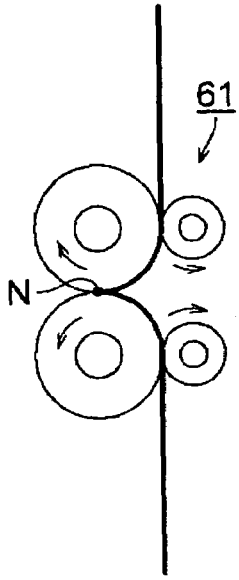
Figure 9C:
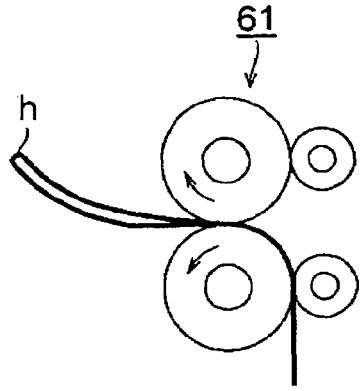
Figure 9D:
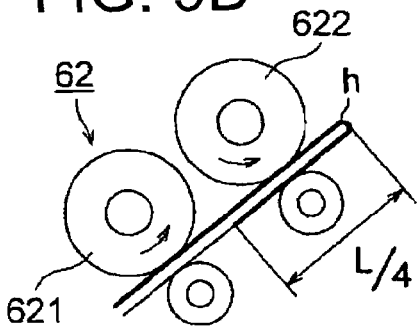
Figure 9E:
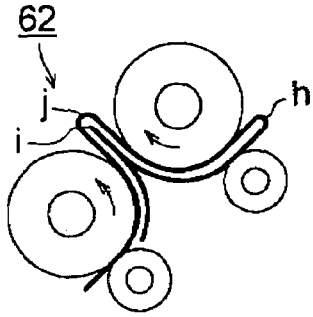
Figure 9F:
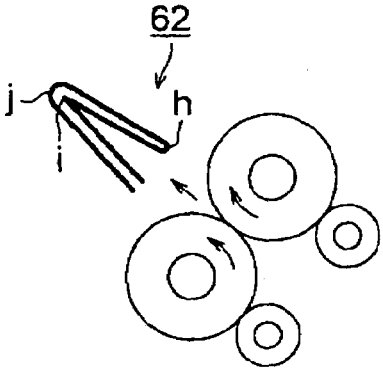
Figure 9G:
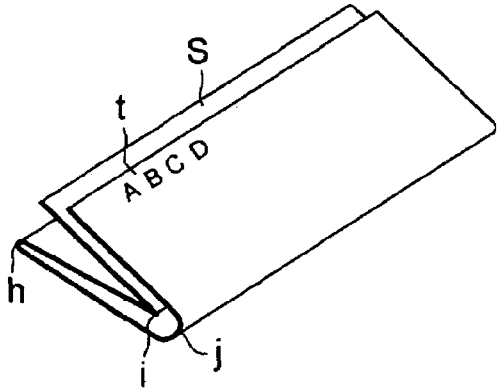
FIG. 9G is a perspective view of the double parallel sheet.

Referring to FIG. 9G, there is shown a perspective view of the sheet S folded in double parallel. Reference characters h, i, j, and t designate the first fold, the second fold, the third fold, and the image surface of the sheet S folded in double parallel, respectively.

<Gate Fold Processing>

The gate fold processing of a sheet S includes first fold processing in the first folding unit 61, second fold processing in the second folding unit 62, and third fold processing in the third folding unit 63.

Figure 10A:
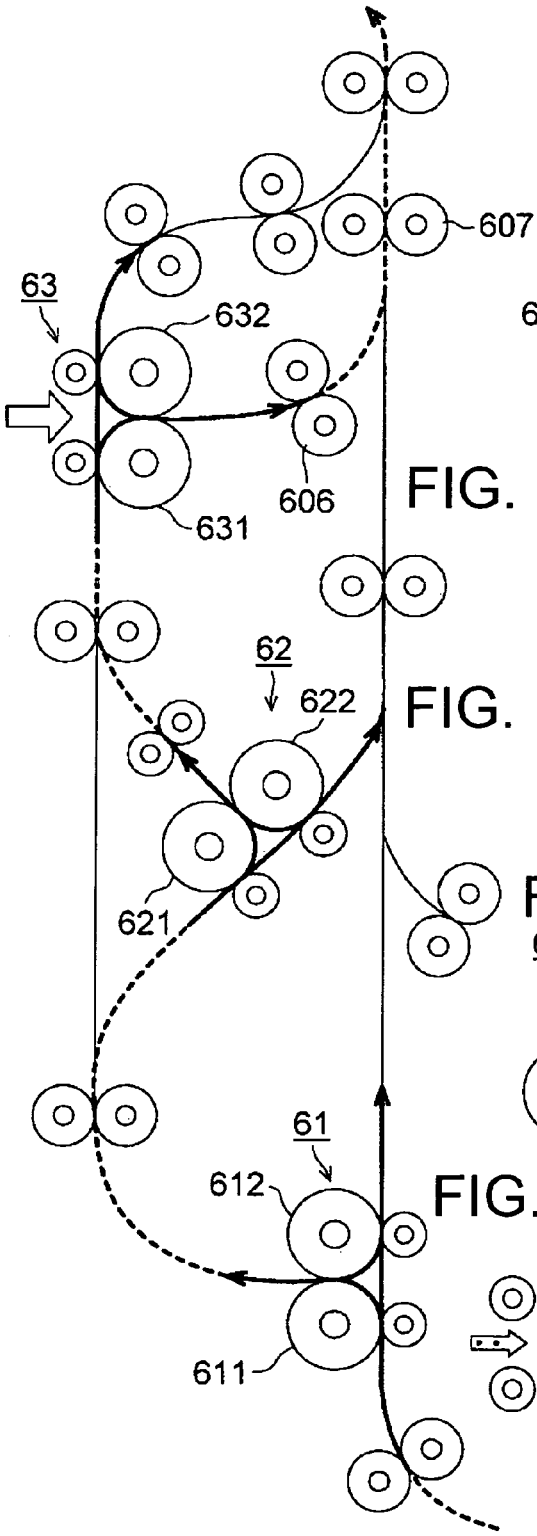
FIG. 10A is a front view showing a sheet processing route during gate fold processing.
Figure 10B:
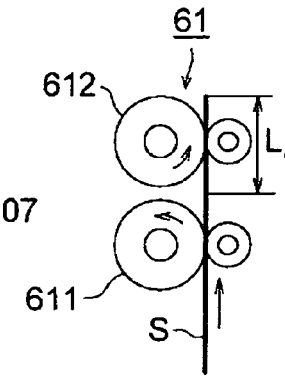
FIGS. 10B, 10C, 10D, 10E, 10F, 10G, and 10H are pattern diagrams of gate fold processing steps.
Figure 10C:
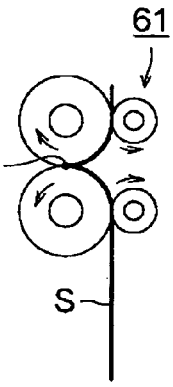
Figure 10D:
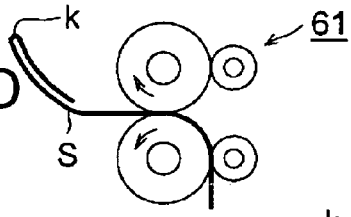
Figure 10E:
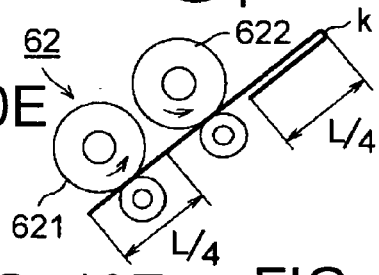
Figure 10F:
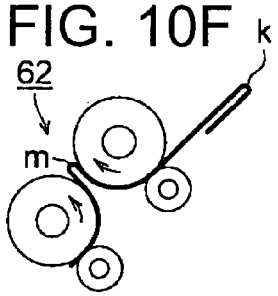
Figure 10G:
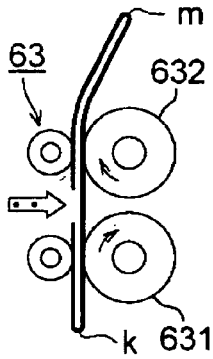

Referring to FIG. 10A, there is shown a front view of a processing route of the sheet S during the gate fold processing. Referring to FIGS. 10B to 10G, there are shown pattern diagrams of gate fold processing steps in the first folding unit 61, the second folding unit 62, and the third folding unit 63.

In the first folding unit 61, the sheet S stops at the position where the front end of the sheet S is one-quarter of the entire sheet length L away from the opposing position of the folding rollers 611 and 612. Thereafter, the first fold processing is performed by means of the folding rollers 611 and 612 and thereby a first fold k is formed on the sheet S (See FIGS. 10B to 10D).

In the second folding unit 62, the sheet S having the first fold k stops at the position where the rear end of the sheet S is one-quarter of the entire sheet length L away from the opposing position of the folding rollers 621 and 622. Thereafter, the second fold processing is performed by means of the folding rollers 621 and 622, and thereby a second fold m is formed on the sheet S (See FIGS. 10E to 10F).

Figure 10H:
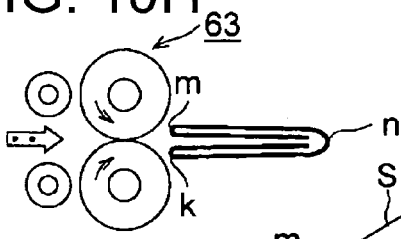

In the third folding unit 63, the sheet S having the first fold k and the second fold m stops at the position where the center of the sheet S in the conveying direction corresponds to the opposing position of the folding rollers 631 and 632. Thereafter, the third fold processing is performed by means of the folding rollers 631 and 632, and thereby a third fold n is formed on the sheet S (See FIGS. 10G and 10H).

The sheet S whose gate fold processing has been completed is sandwiched between the conveying rollers 606 and the conveying rollers 607 and discharged from the third folding unit 63 to the first conveying path p1 with the third fold n frontward (See FIG. 10A).

Figure 10I:
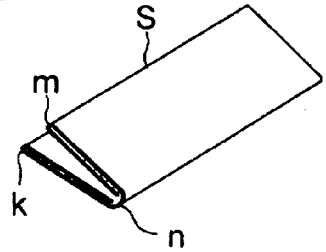
FIG. 10I is a perspective view of the gatefold sheet.

Referring to FIG. 10I, there is shown a perspective view of the sheet S folded in a gate fold. Reference characters k, m, n, and t designate the first fold, the second fold, the third fold, and the image surface of the sheet S, respectively.

<Perforation Function>

Figure 12A:
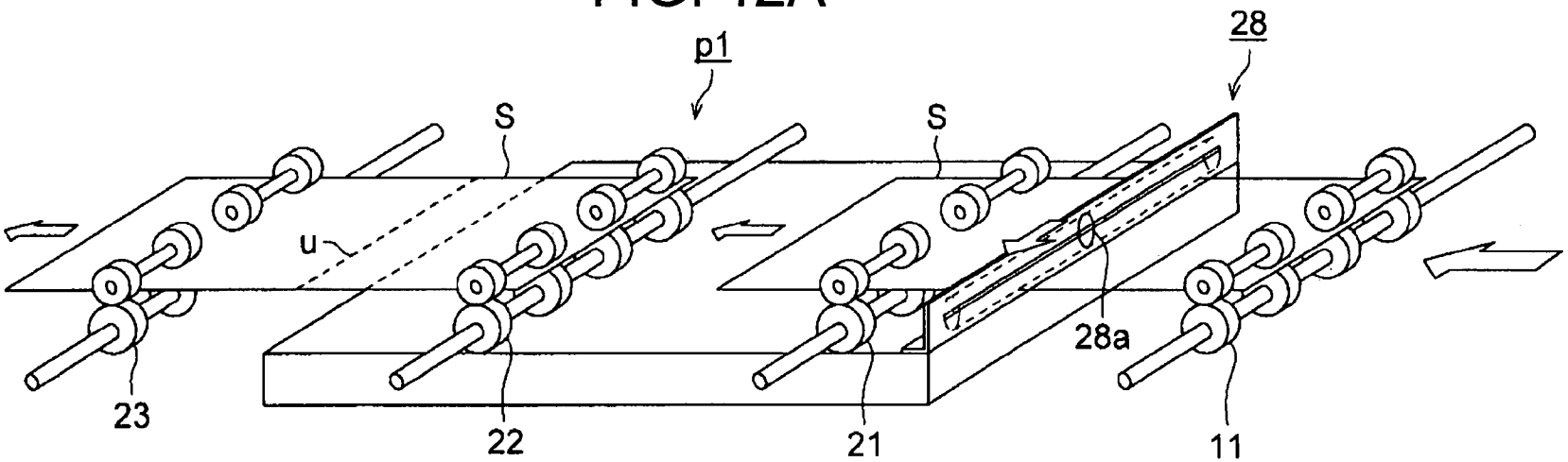
FIG. 12A is a perspective view of a first conveying path having a perforating means.

Referring to FIG. 12A, there is shown a perspective view of the first conveying path p1 having a perforating means 28.

There is disposed the perforating means 28 on the downstream side of the inlet roller 11 in the sheet conveying direction and on the upstream side of the conveying roller 21 on the first conveying path p1 (See FIG. 2). The sheet S is perforated at u in a predetermined position by means of a toothed spur 28*a* or the like of the perforating means 28.

<Single-Sheet Cutting Function>

Figure 12B:
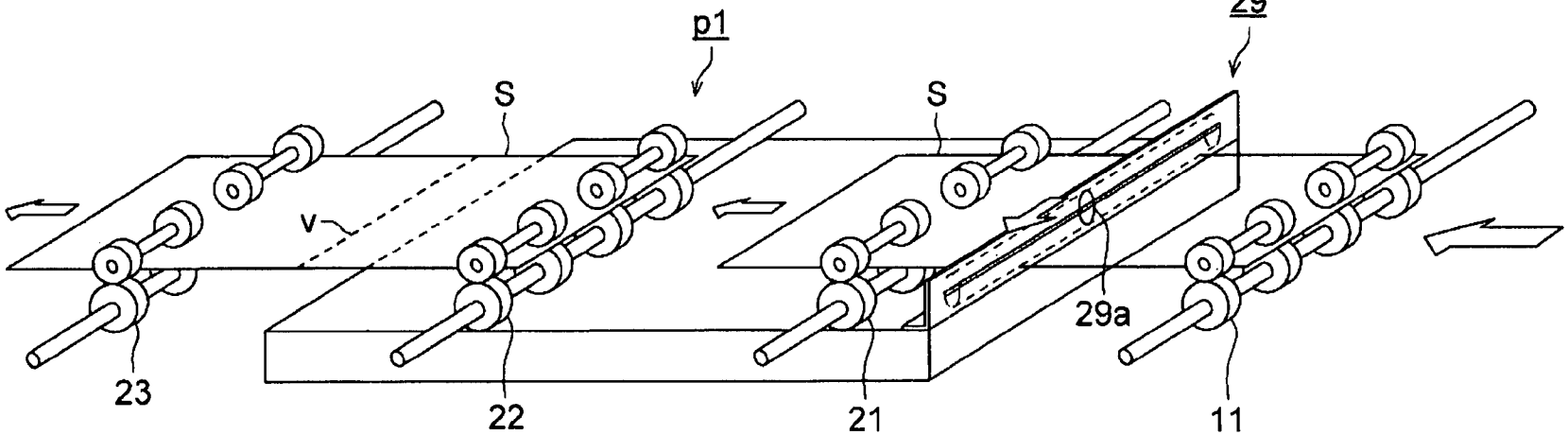
FIG. 12B is a perspective view of a the first conveying path having a cutter unit.

Referring to FIG. 12B, there is shown a perspective view of the first conveying path p1 having a cutter means 29.

A roll cutter 29*a* of a cutter means 29 disposed in parallel or exchangeably in the perforating means 28 cuts a sheet S using a slit v in a predetermined position (single-sheet cutting function).

<Edge Stapling Machine>

Figure 13:
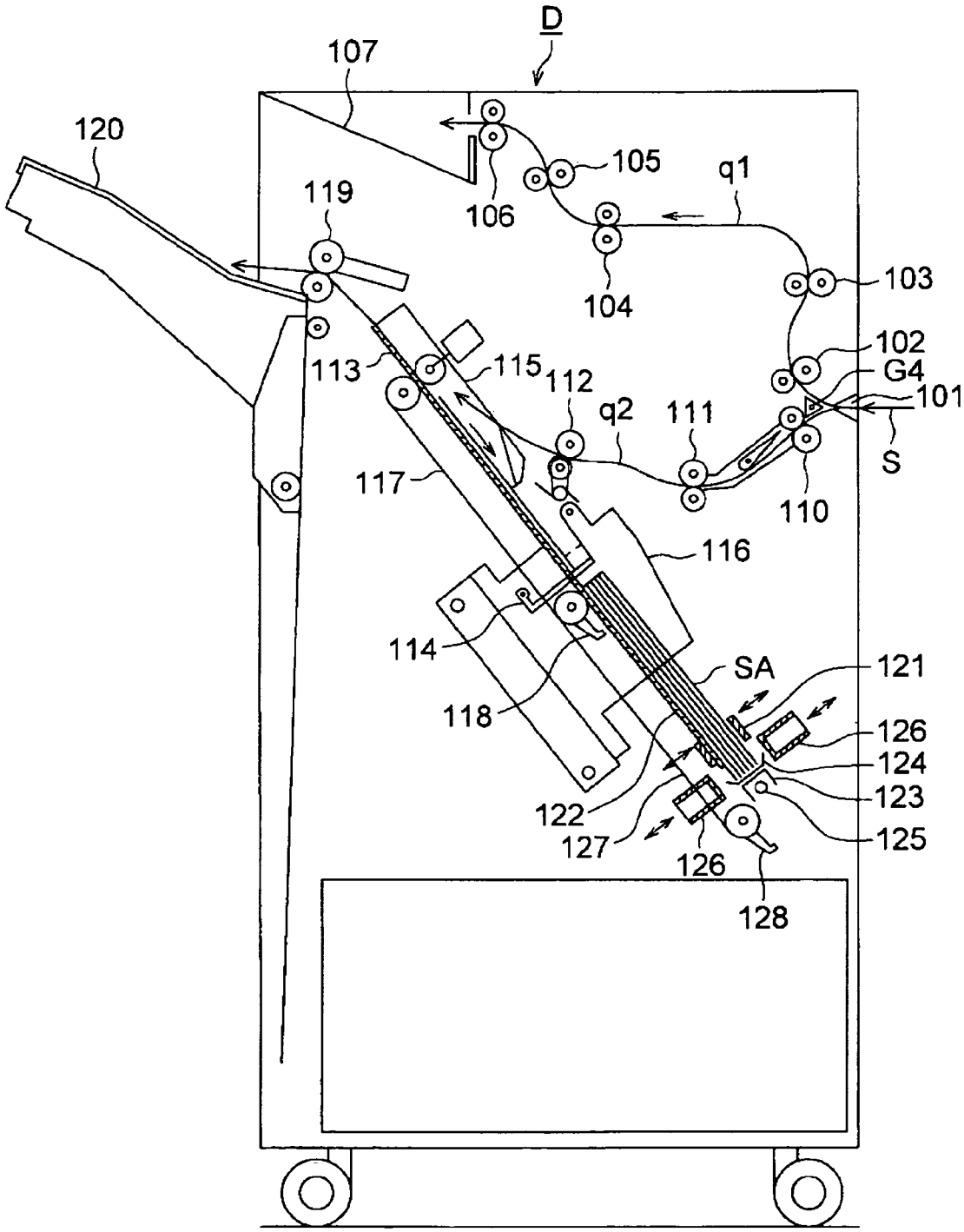
FIG. 13 is a front view of an edge stapling machine.

Referring to FIG. 13, there is shown a front view of an edge stapling machine (postprocessing unit) D.

<Edge Stapling Function>

A sheet S discharged from the image forming apparatus A or any other postprocessing unit and introduced into an inlet (edge stapling carry-in unit) 101 of the edge stapling machine D is conveyed to one of an upper conveying path q1 and a lower conveying path q2 of a conveying path switching means G4. The sheet S conveyed to the conveying path q1 is conveyed being sandwiched between conveying rollers 102 to 105, discharged by discharging rollers 106, and placed on a sub-discharge tray (top tray) 107 as an edge stapling discharge unit disposed at the top of the edge stapling machine D. The sub-discharge tray 107 accommodates recorded sheets each having an image formed in trial or recorded sheets discharged after handling a paper jam.

Figure 11C:
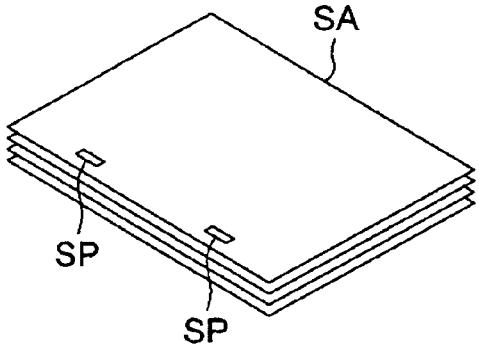

The sheet S conveyed to the conveying path q2 is conveyed being sandwiched between conveying rollers 110 and conveying rollers 111, discharged by registration rollers 112 and sequentially placed on an intermediate stacker 113 disposed slantwise. The sheet S placed on the intermediate stacker 113 is positioned by a sheet rear end alignment with a sheet rear end abutting member 114 and a sheet width alignment with a sheet width aligning member 115. Thereafter, it is fixed with staples SP by using a stapler 116 at one or two places in the vicinity of the lateral margin of the sheet S and thereby a booklet SA is made (stapling function). Referring to FIG. 11C, there is shown a perspective view of the stapled booklet SA.

The rear end of the stapled booklet SA shifts diagonally upward on the intermediate stacker 113 by action of a discharge pawl 118 fixed to a rotating discharge belt 117. The sheet S is then discharged by discharging rollers 119 of an edge stapling discharge unit and placed on the main discharge tray (open discharge unit) 120.

<Tape Binder Function>

Upon setting of a tape binder function, the sheet rear end abutting member 114 retracts from the surface of the intermediate stacker 113. A paper bulk placed on the intermediate stacker 113 and positioned by the sheet rear end alignment with the sheet rear end abutting member 114 and the sheet width alignment with the sheet width aligning member 115 is gripped by a sheet bulk grip conveying member 121 and is conveyed toward a rear surface abutting member 123 disposed diagonally downward on the intermediate stacker 122.

An adhesive tape is previously standing by in contact against the abutting surface of the rear surface abutting member 123. The rear end of the sheet bulk moving downward on an intermediate stacker 122 is put in contact against the adhesive tape 124 supported by the rear surface abutting member 123 and then stopped.

A tape heating means 125 is heating the rear surface abutting member 123, and therefore the adhesive tape 124 has a melted adhesive surface. The back of the sheet bulk is put in contact with the melting adhesive surface of the adhesive tape 124 with pressure and thereby it is adhesive bonded to the surface.

Figure 11D:
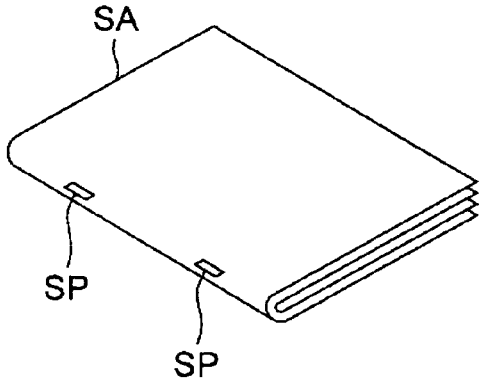
Figure 11E:
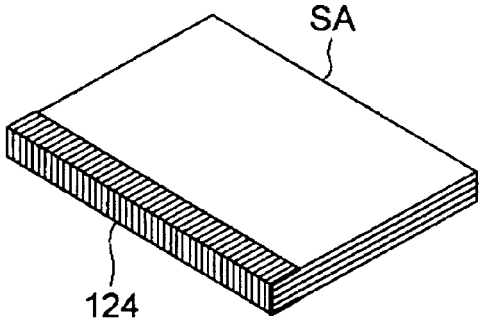
Figure 11F:
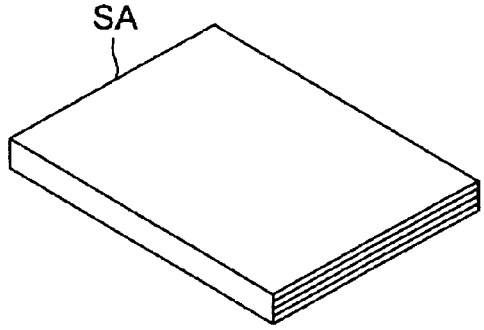

A width of the adhesive tape 124 is longer than a thickness of the back of the paper bulk. After the adhesive bonding of the sheet bulk at the back thereof, a vertical pair of pressing members 126 move in the direction of thickness of the sheet bulk and fold the adhesive tape 124 at both ends thereof. The melting adhesive surface of the adhesive tape 124 is put in contact with pressure with the sheet bulk on both sides thereof for bonding to complete the booklet SA. Referring to FIG. 11E, there is shown a perspective view of the booklet SA made by using the tape binder function.

After the completion of the tape binder processing, the grip of the sheet bulk grip conveying member 121 and the pressure of the pressing member 126 are released. The rear end of the booklet SA moves diagonally upward on the intermediate stacker 122 by action of the discharge pawl 128 fixed to the rotating discharge belt 127. Passing through the intermediate stacker 113, the booklet SA is then discharged by the discharging roller 119 and placed on the main discharge tray.

<Pasting Function>

The edge stapling machine D can also be provided with a pasting bookbinding function instead of the tape binder function. For the pasting bookbinding function, there are disposed a rotating pasting roller, a pasting roller moving means, and a paste container in the vicinity of the rear surface abutting member 123.

Upon setting of the pasting function, melting paste held by the rotating pasting roller is applied to the back of the paper bulk gripped by the sheet bulk grip conveying member 121 and it is bonded, by which a booklet SA is made.

[Center Stitching Machine]

Figure 14:
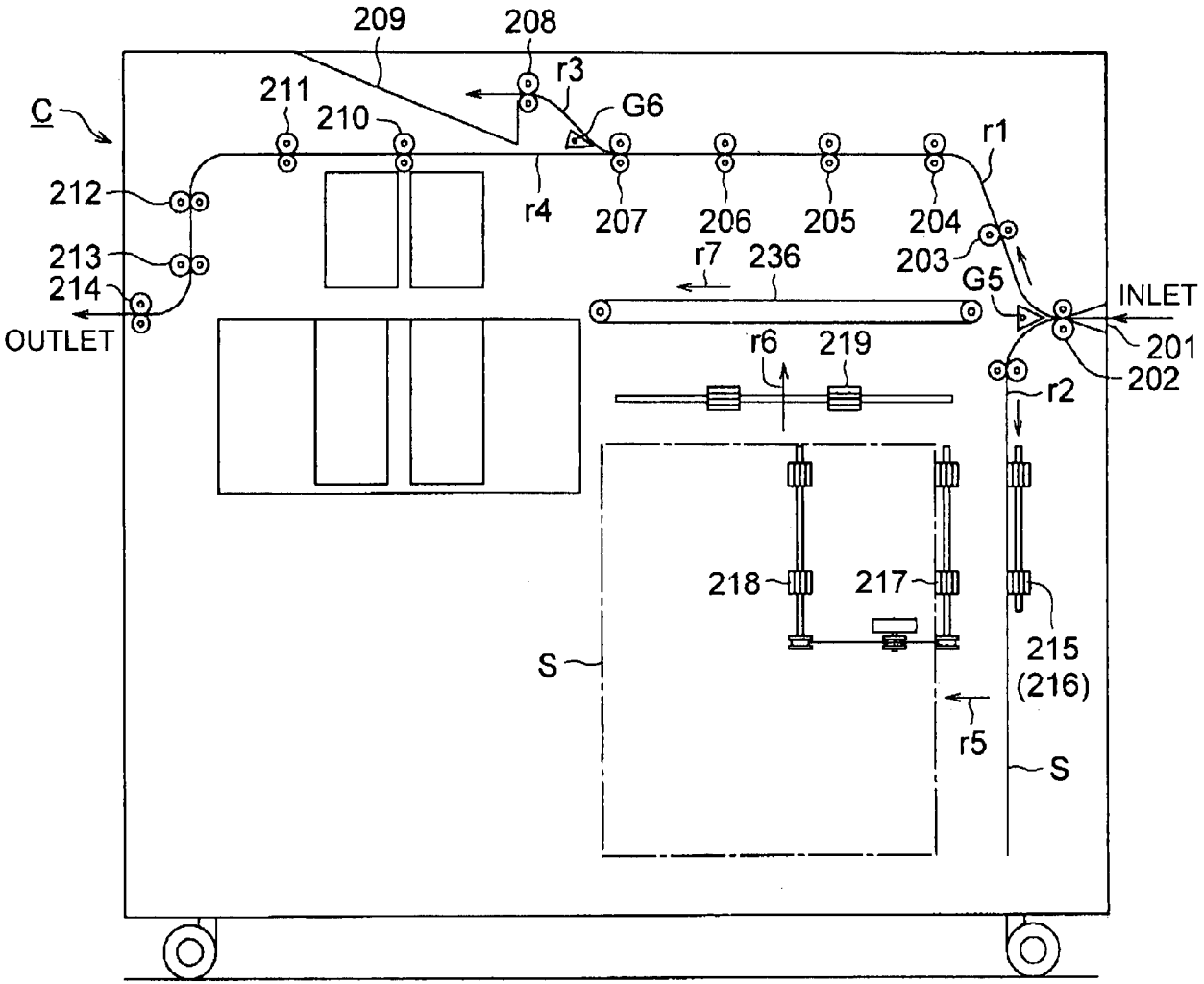
FIG. 14 is a front view of a center stitching machine.
Figure 15:
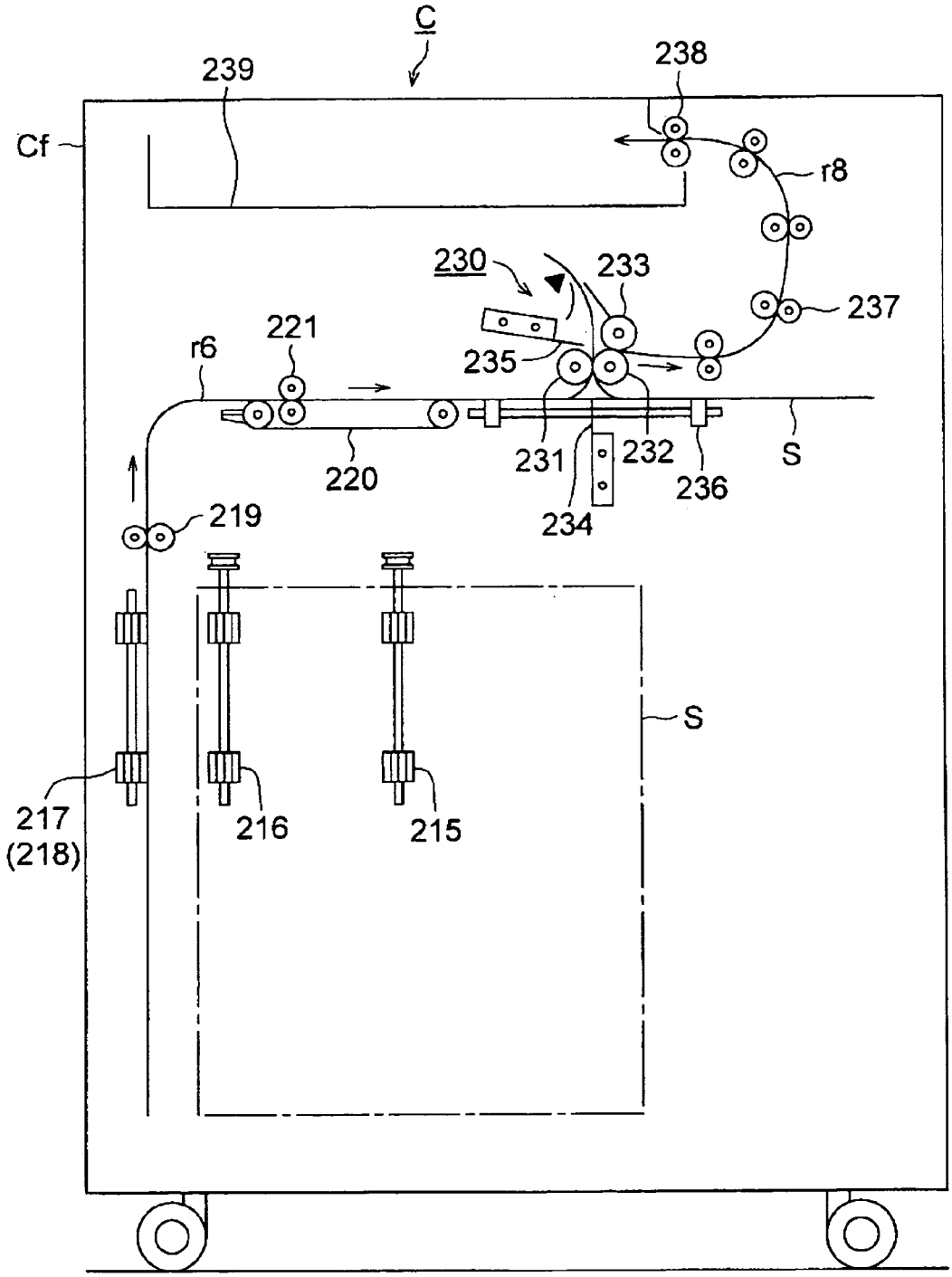
FIG. 15 is a left-side elevation view of the center stitching machine.
Figure 16:
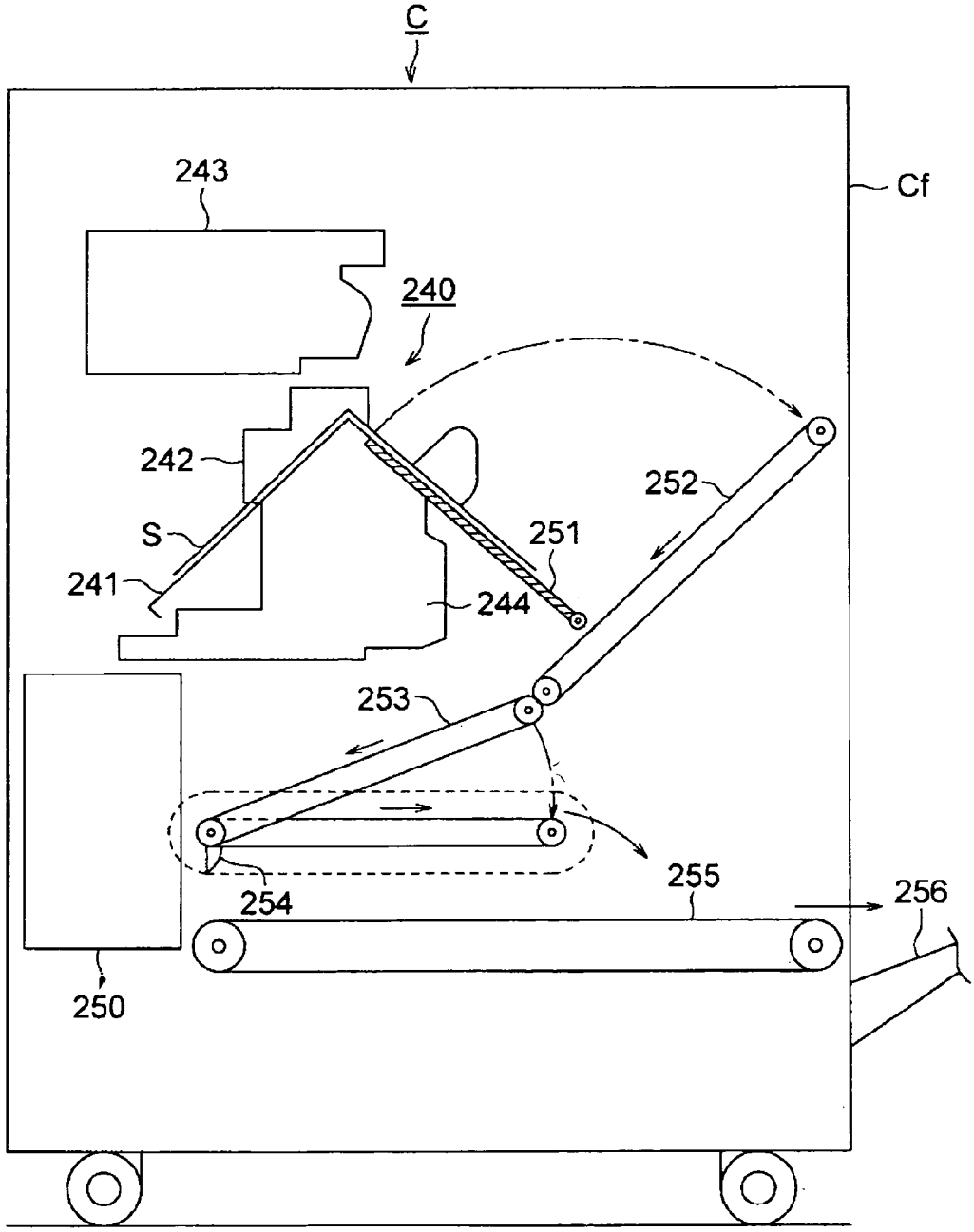
FIG. 16 is a right-side elevation view of the center stitching machine.
Figure 17:
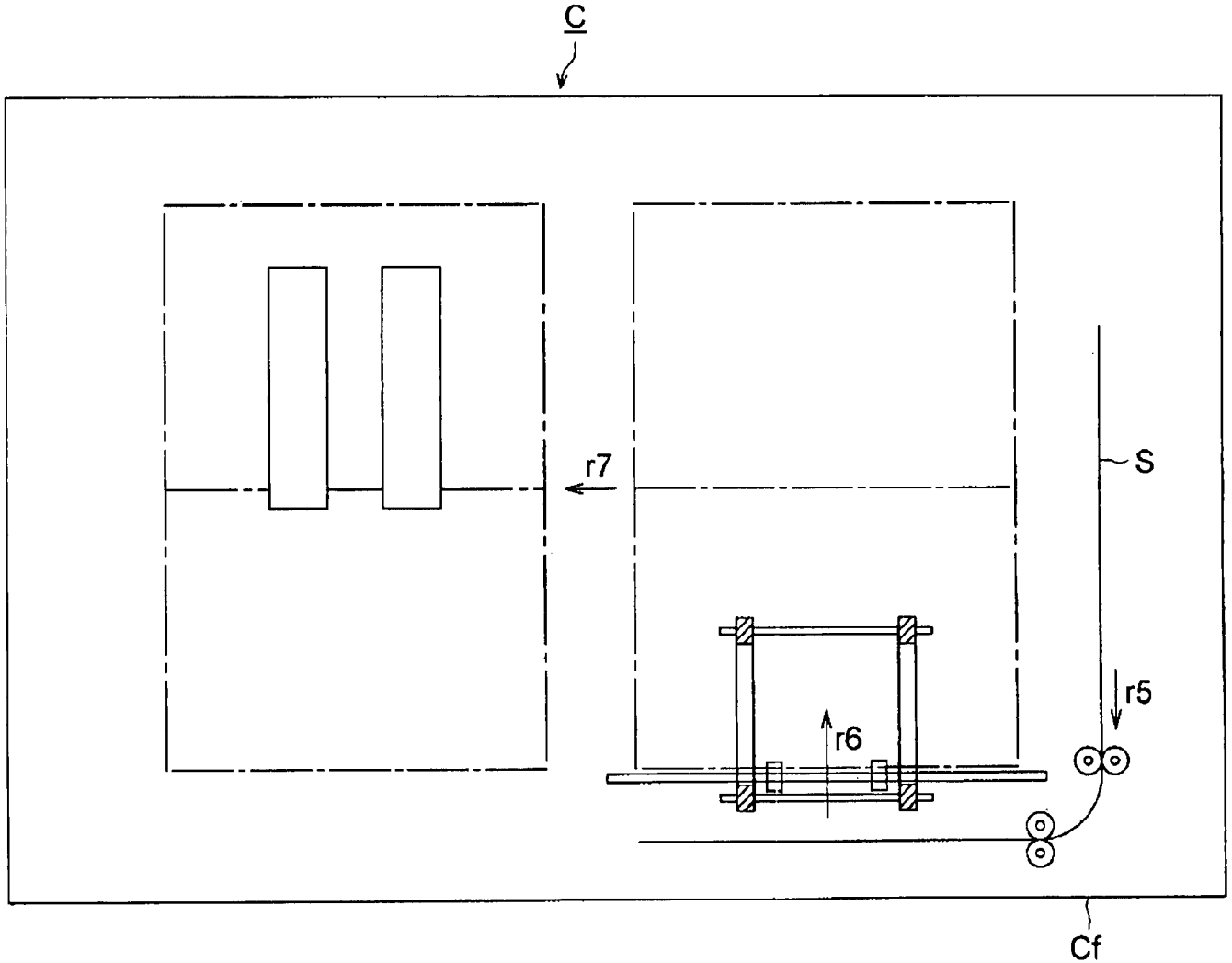
FIG. 17 is a front view of the center stitching machine.
Figure 18:
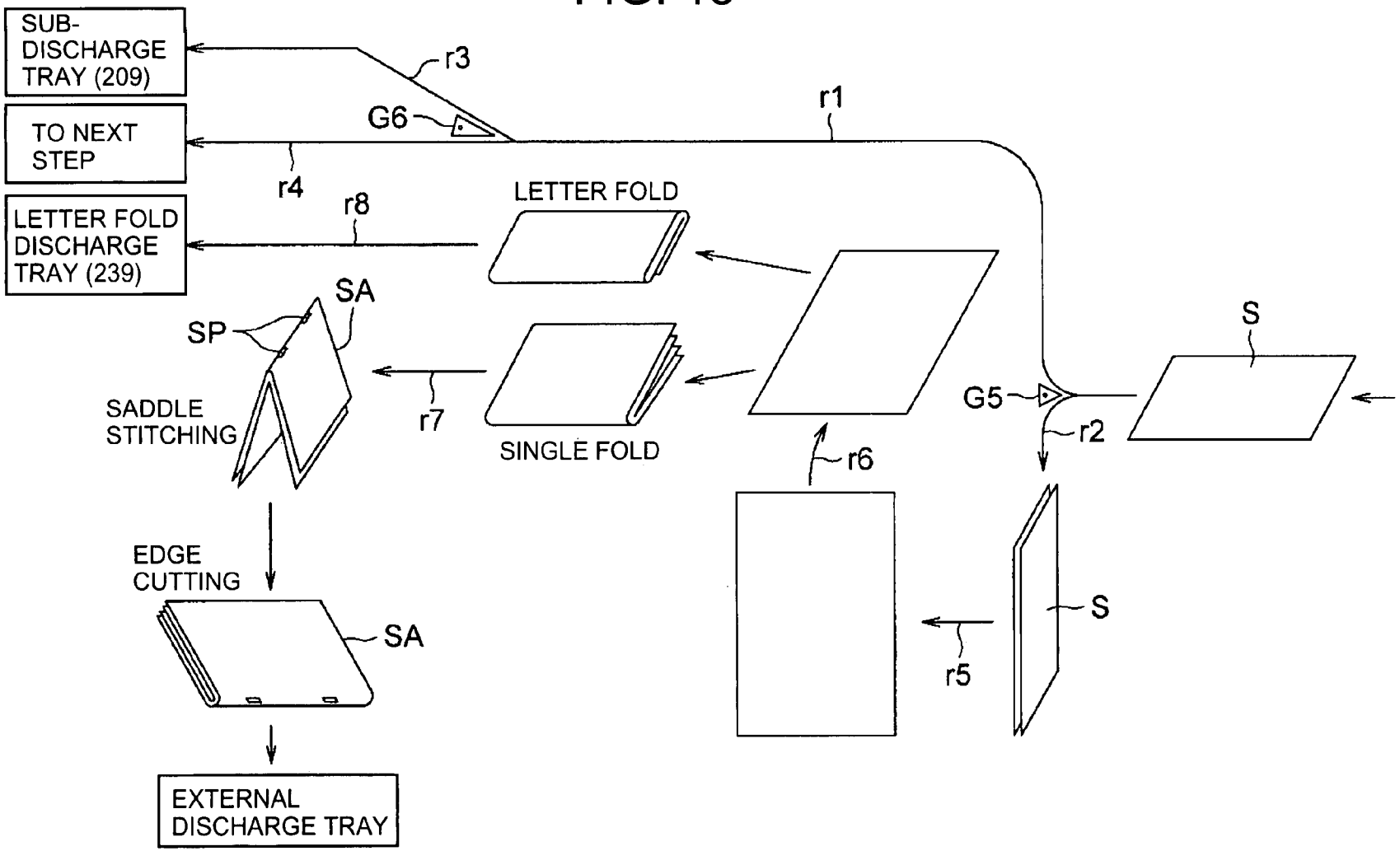
FIG. 18 is a pattern diagram showing paper conveying steps of the center stitching machine.

Referring to FIG. 14, there is shown a front view of a center stitching machine (a postprocessing unit). Referring to FIGS. 15, 16, and 17, there are shown a right side view, a left side view, and a plan view of the center stitching machine, respectively. Referring to FIG. 18, there is shown a schematic view of sheet conveying steps of the center stitching machine C.

A sheet S discharged from the image forming apparatus A or any other processing device and introduced into an inlet (the center stitching carry-in unit) 201 of the center stitching machine C is sandwiched between inlet rollers 202 and conveyed to an upper conveying path r1 or a lower conveying path r2 of a conveying path switching means G5.

The sheet S conveyed to the conveying path r1 is conveyed being sandwiched between conveying rollers 203 to 207 and conveyed to an upper conveying path r3 or a lower conveying path r4 of a conveying path switching means G6.

The sheet S advanced to the upper conveying path r3 is discharged by means of discharging rollers 208 and then placed on a sub-discharge tray (top tray) 209 as a center stitching discharge unit disposed at the top of the center stitching machine C.

The sheet S advanced to the lower conveying path r4 is conveyed being sandwiched between conveying rollers 210 to 213 and discharged by means of discharging rollers 214 of the center stitching discharge unit.

<First Perpendicularly Deflecting Conveyance>

The sheet S conveyed to the lower conveying path r2 of the conveying path switching means G5 moves down substantially in the vertical direction and temporarily stops at a predetermined position to be accommodated there. In this stop position, a small number of subsequent sheets S are stacked to be accommodated (indicated by a solid line in FIG. 14 and by a dashed line in FIG. 15).

<Second Perpendicularly Deflecting Conveyance>

The accommodated sheets S are moved deflecting perpendicularly with respect to the page surface of FIG. 14 toward this side by conveying rollers 215 to 218 and a guide not shown. The sheets S pass through a conveying path r5 extending to the front side Cf within the center stitching machine C with the surface of the sheets erected and temporarily stop at a predetermined position (the position indicated by a dashed line in FIG. 14 and a solid line in FIG. 15).

<Third Perpendicularly Deflecting Conveyance>

Subsequently, the sheets S are conveyed vertically upward by means of conveying rollers 219 and deflected in the horizontal direction. Then, they are moved to the rear side within the center stitching machine C by means of a conveying belt 220 and conveying rollers 221 (a conveying path r6).

<Single Fold Function>

A folding unit 230 is disposed on the downstream side of the conveying belt 220 in the sheet conveying direction. The folding unit 230 comprises folding rollers 231, 232, 233 and folding plates 234, 235.

Having reached the folding unit 230, a small number of sheets S are sandwiched between folding rollers 231 and 232 rotating in opposite directions and a folding knife 234 moving straight. A fold is then formed in the widthwise direction of the sheets S in the middle of the sheet between the front end and the rear end (See FIGS. 4E and 5F).

Thereafter, the folding rollers 231 and 232 are rotated in reverse directions. The sheets S with the fold are returned back to the horizontal conveying path being spaced apart from the folding rollers 231 and 232. The sheets S are subsequently conveyed to a conveying path r7 in the direction of an extension of the fold (in the direction perpendicular to the page surface in FIGS. 15 and 16 or in the direction indicated by the arrow in FIG. 14) by means of a conveying belt 236 (See FIG. 14) and then fed into a center stitching unit 240.

As stated above, the folding unit 230 folds the small number of sheets S to form a clear fold and sequentially feeds the sheets into the center stitching unit 240, thereby successfully making a high-grade booklet with less bulging in the fold portion.

<Letter Fold Function>

In the folding unit 230, a sheet S stops at the position where the front end of the sheet S is one-third of the entire sheet length L away from the opposing position of the folding rollers 231 and 232. Thereafter, first fold processing is performed by means of the folding rollers 231 and 232 and thereby a first fold f is formed on the sheet S.

The sheet S stops at the position where the first fold f of the sheet S is one-third of the entire sheet length L away from the opposing position of the folding rollers 231 and 232. Thereafter, the second fold processing is performed by means of the folding rollers 232 and 233 and thereby a second fold g is formed on the sheet S (See FIG. 8).

In the folding unit 230, the sheet S folded in three passes through a conveying path r8 made of a plurality of conveying rollers 237 and guides and it is discharged to a discharge tray (top tray) 239 by means of discharging rollers 238.

<Center Stitching Function>

A sheet S single-folded in the folding unit 230 is conveyed by means of a conveying belt and a guide means not shown in the direction of the conveying path r7 and then placed on a center member 241 of the center stitching unit 240. Subsequent single-folded sheets S pass through the conveying path r7 continuously and stacked on the center member 241.

The center member 241 has a substantially right-angled convex form in the upper portion. The single-folded sheets S are mounted on the center member 241 with their fold a (See FIG. 4E or 5F) matching the top ridge line of the center member 241.

The plurality of sheets S mounted on the center member 241 are aligned by a width aligning member 242.

In the upper portion of the center member 241, a stapling mechanism 243 is supported so as to be vertically rotatable. A staple receiving mechanism 244 is fixed within the center member 241.

The stapling means having the two-part structure made of the stapling mechanism 242 and the staple receiving mechanism 243 is disposed in two places in the direction of the sheet fold. Upon setting of the center stitching in the operating unit, the stapling mechanism 243 moves downward to perform the center stitching. More specifically, the two pairs of stapling means strike a staple into the paper bulk on the center member 241 along the fold a at two places on the central spread. Referring to FIG. 11D, there is shown a perspective view of a center-stitched booklet SA.

<Paper Cutting Function>

The sheet bulk center-stitched in the center stitching unit 240 is placed on a conveying belt 252 with being supported by a pivotable guide member 251 with a rocking motion in the direction indicated by a chain line. With the rotation of the conveying belt 252, the sheet bulk is conveyed diagonally downward. It is then transferred to a rotating conveying belt 253 and stops at a predetermined position.

Thereafter, the conveying belt 253 rocks and is put in a horizontal condition. A fore edge (a free end in the other side of the fold) of the paper bulk placed on the horizontal conveying belt 253 is irregular according to the number of sheets of the booklet SA. Therefore, a cutting means (trimmer) 250 trims the sheet bulk to align the edge.

The booklet SA that has been completed with the edge cutting is placed on the counterrotating conveying belt 253. It is then conveyed with the rear end pressed by a discharge pawl 254 fixed to the conveying belt 253. Thereafter, it drops in the direction indicated by an arrow from the tip of the conveying belt 253. The dropped booklet SA is discharged to a discharge tray 256 disposed in the outside of the front side Cf of the center stitching machine C by means of a rotating conveying belt 255.

As another mechanism, it is possible to arrange a stacker that can be pulled out of the edge stapling machine body at the location of the conveying belt 253, so that booklets SA can be stacked there.

[High-Volume Stacker]

Figure 19:
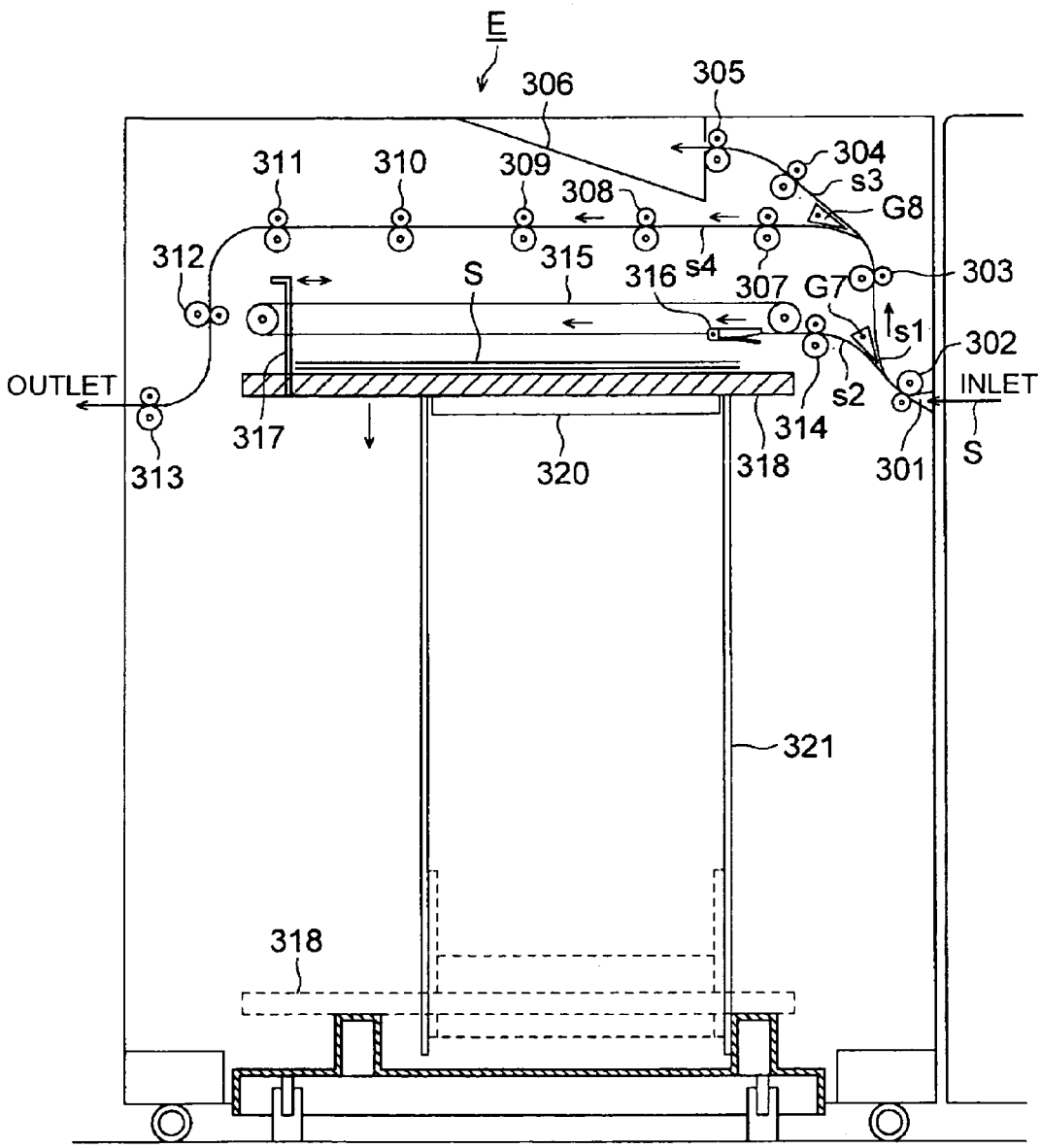
FIG. 19 is a front view of a high-volume stacker showing steps of introducing a sheet.

Referring to FIG. 19, there is shown a front view of a high-volume stacker E illustrating steps of introducing a sheet S.

A sheet S discharged from the image forming apparatus A or any other postprocessing unit and introduced into an inlet (a high-volume stacking carry-in unit) 301 of the high-volume stacker E is sandwiched between inlet rollers 302 and conveyed to an upper conveying path s1 or a lower conveying path s2 of a conveying path switching means G7.

The sheet S conveyed to the conveying path s1 is conveyed being sandwiched between conveying rollers 303 and then conveyed to an upper conveying path s3 or a lower conveying path s4 of a conveying path switching means G8.

The sheet S advanced to the upper conveying path s3 is discharged by means of a discharging roller 305, passing through conveying rollers 304. It is then placed on a sub-discharge tray (top tray) 306 as a high-volume stacking discharge unit-disposed at the top of the high-volume stacker E.

The sheet S advanced to the lower conveying path s4 is conveyed being sandwiched between conveying rollers 307 to 312, discharged to the outside of the high-volume stacker by means of discharging rollers 313 of the high-volume stacking discharge unit, and then fed into any other postprocessing unit.

The sheet S advanced to the conveying path s2 is conveyed being sandwiched between conveying rollers 314 and further advanced toward the left as shown with the front end of the sheet S gripped by a gripper 316 fixed to a rotating belt 315.

A sheet front-end regulating member 317 is standing by in the vicinity of the left end of the belt 315. The sheet front-end regulating member 317 shifts to a predetermined position corresponding to a size of the introduced sheet S and stops there to align the front end of the sheet.

Upon a contact of the front end of the sheet S against the sheet front-end regulating member 317, the grip of the gripper 316 is released and the sheet S drops onto the sheet stacking table 318. The sheet stacking table 318 is movable up and down with being supported by a lifting member 320. The lifting member 320 is driven by a driving means not shown and moves up and down along a guide member 321.

As sheets S are sequentially stacked on the sheet stacking table 318, the sheet stacking table 318 and the lifting member 320 move down with the top surface of the stacked sheets S keeping the initial position.

Figure 20:
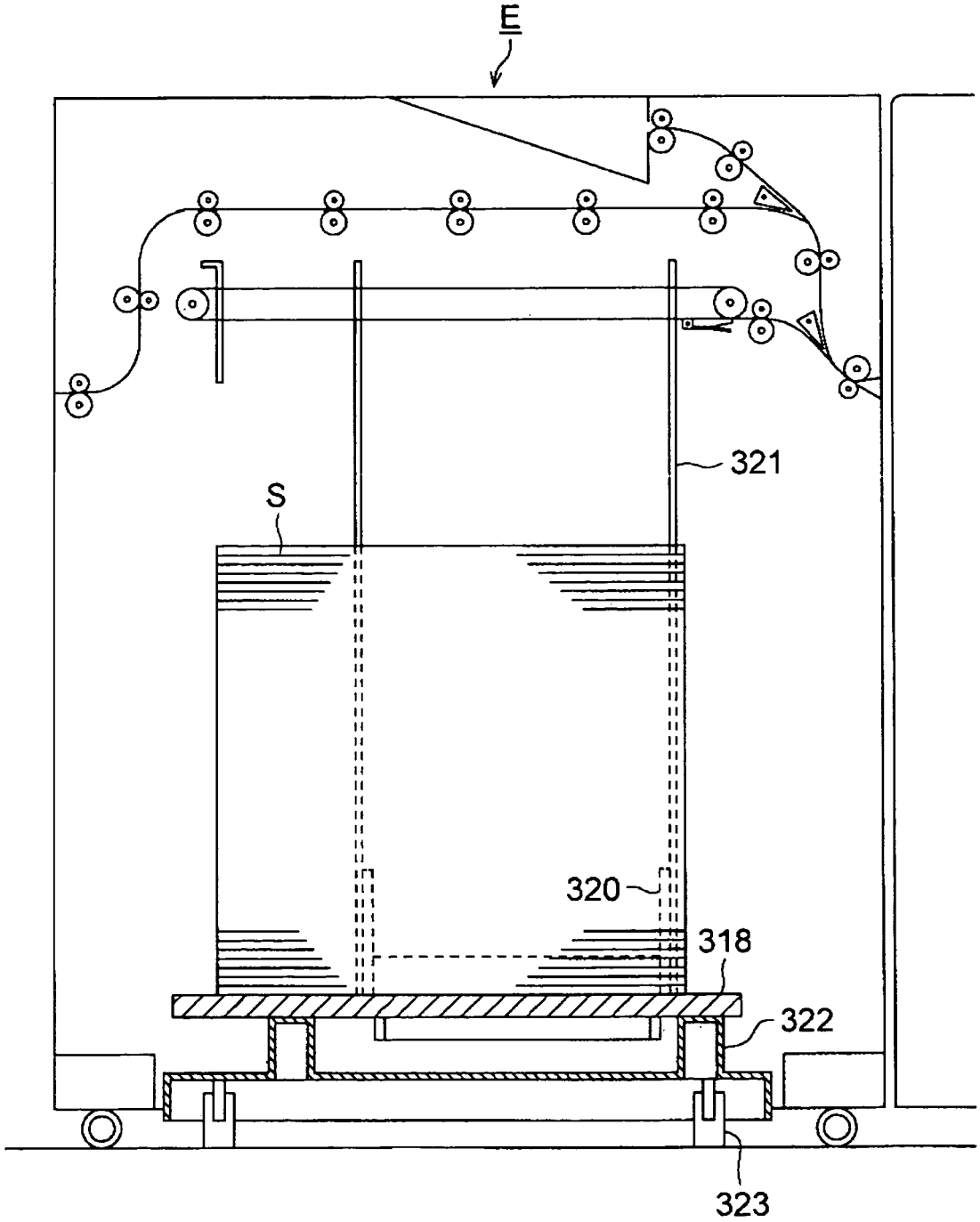
FIG. 20 is a front view of the high-volume stacker showing steps of discharging a sheet.

Referring to FIG. 20, there is shown a front view of the high-volume stacker E for illustrating steps of discharging the sheets S.

To take out the sheets S accommodated in the high-volume stacker E, a release of the high-volume stacker E is specified in the operating unit. By this specification, the driving means moves down the lifting member 320. With the downward motion of the lifting member 320, the sheet stacking table 318 also moves down integrally.

A carriage (a detachable high-volume stacking unit) 322 having wheels is movably disposed at the bottom of the high-volume stacker E. The sheet stacking table 318 abuts on the top of the carriage 322 and mounted thereon. The lifting member 320 further continues to move down and stops after releasing the holding of the sheet stacking table 318.

An operator can easily take out the sheets S stacked on the sheet stacking table 318 on the carriage 322 by opening the front door of the high-volume stacker E and pulling out the carriage 322 to the near side manually or electrically.

[Case Binding Machine]

Figure 21:
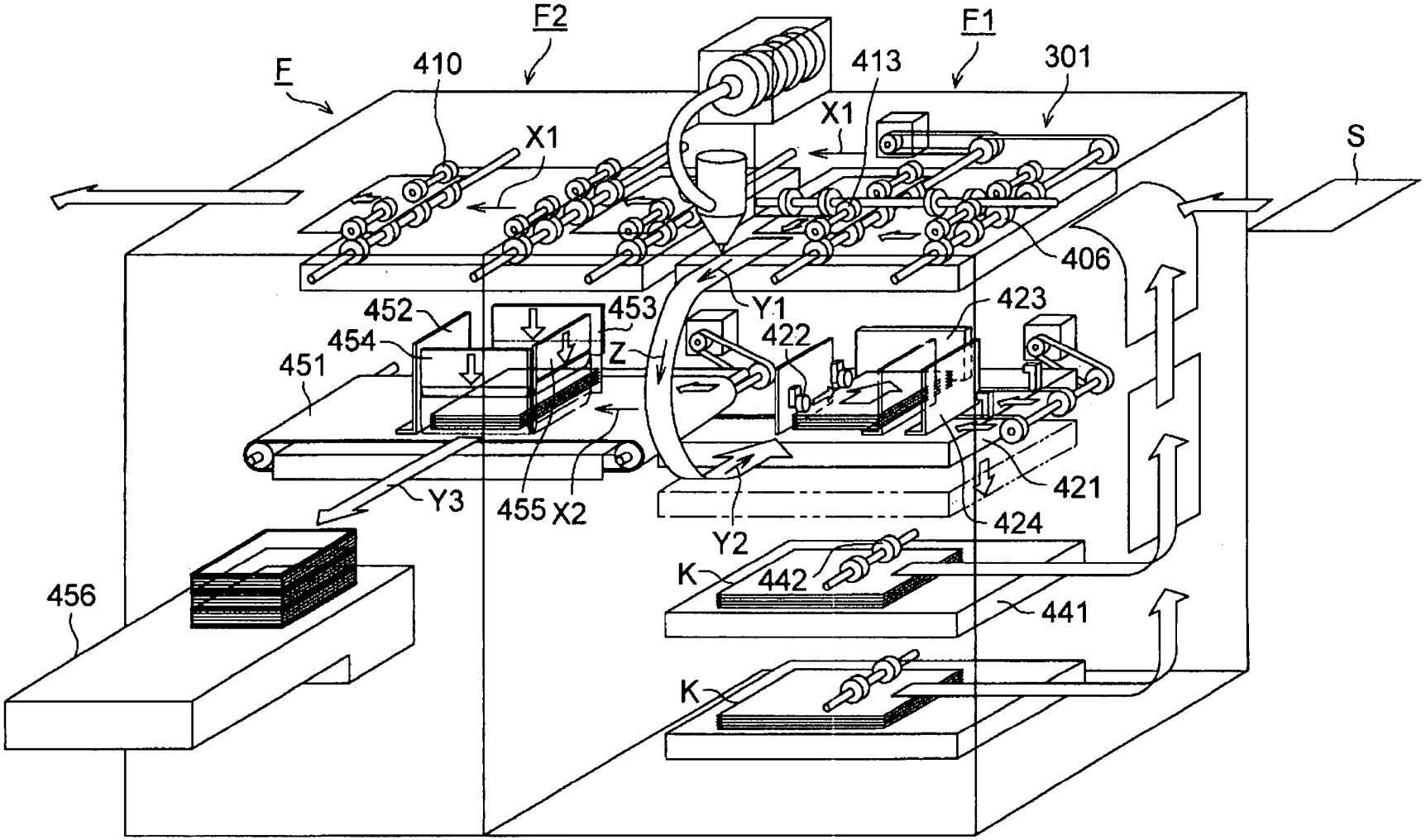
FIG. 21 is a perspective view of a case binding machine comprising a case binding unit and a cutting unit.
Figure 22:
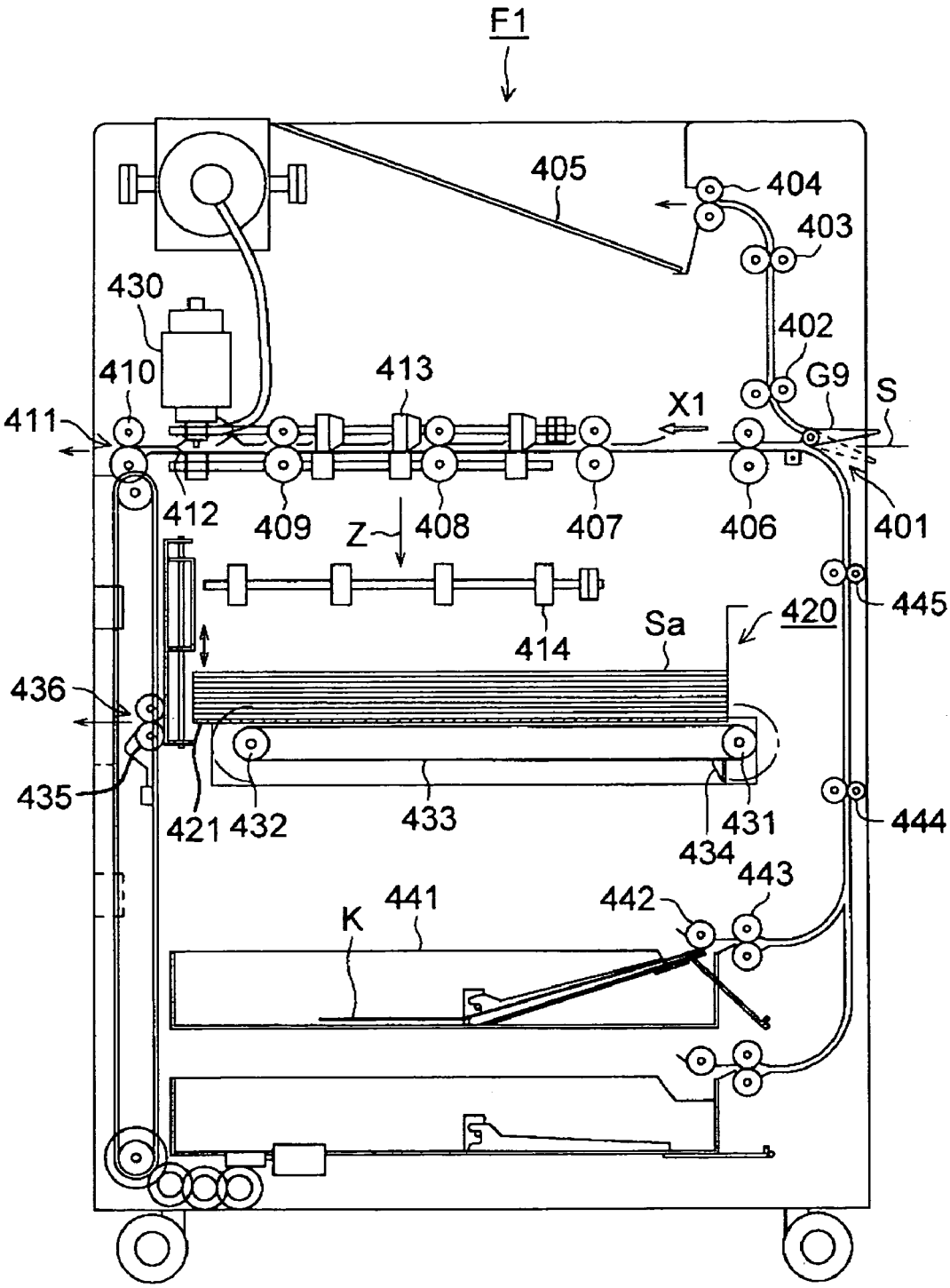
FIG. 22 is a front view of the case binding unit.

Referring to FIG. 21, there is shown a perspective view of a case binding machine F (a postprocessing unit) comprising a case binding unit F1 and a cutting unit F2. Referring to FIG. 22, there is shown a front view of the case binding unit.

A sheet S introduced into the case binding carry-in unit 401 is conveyed to one of an upper discharging path and a horizontal conveying path selected by means of a conveying path switching means G9.

<Unprocessed Sheet Conveyance>

A sheet S advanced to the upper discharge path is sandwiched between conveying rollers 402 and conveying rollers 403 and discharged to a sub-discharge tray (top tray) 405 as a case binding discharge unit by means of discharging rollers 404.

Upon setting of a straight sheet discharge in the operating unit, the conveying path switching means G9 closes the upper discharge path and opens the horizontal conveying path to enable the horizontal conveyance. The sheet S advanced to the horizontal conveying path is conveyed being sandwiched between conveying rollers 406 to 409. If the sheet S is not to be pasted, it is sandwiched between discharging rollers 410 and discharged to the outside of the machine from the case binding discharge unit 411 (conveying path X1).

<Feeding Cover Sheet K>

A cover sheet K in the paper cassette 441 disposed in the lower part of the case binding unit F1 is fed by a feed-out roller 442 and a separating roller 443. It is then conveyed by means of conveying rollers 444, 445 and then conveyed toward a conveying path X1, passing through a conveying path under the conveying path switching means G9. The paper cassettes 441 are provided in vertical two stages.

<Sheet Conveyance for Pasting>

Upon setting of a case binding mode, the cover sheet K fed from the paper cassette 441 and a sheet S discharged from the image forming apparatus A or any other postprocessing unit is conveyed being sandwiched between driven-rotating conveying rollers 406 to 409. When the front end of the sheet S abuts on a positioning member 412, a skew of the sheet S is corrected and the sheet S is positioned in the conveying direction (the conveying path X1). Thereafter, the driving is stopped and a driving means not shown causes respective upper rollers of the conveying rollers 406 to 409 to be upwardly retracted from the sheet surface so as to release the contact of the conveying rollers 406 to 409 against the sheet surface.

Furthermore, the sheet S is sandwiched between driven-rotating conveying rollers 413 and conveyed in the conveying direction deflected at a 90-deg angle (conveying path Y1). The sheet S is subsequently sandwiched between conveying rollers 414 and fed into a stacking means 420 after a U-turn conveyance (conveying path Z).

<Pasting Sheet S>

A paste ejector 430 ejects adhesive paste in a line or in an intermittent dashed line on one of the lateral margins of the sheet S traveling from the conveying path Y1 to the conveying path Z by means of the conveying rollers 413 to form a paste spread area on the top surface of the sheet S.

<Stacking, Alignment, and Pressing of Sheets S>

The first sheet S not pasted is conveyed being sandwiched between the driven-rotating conveying rollers 414 and conveyed to a conveying path Y2, and then it is placed on a stacking tray 421. The subsequent second and after pasted sheets S are conveyed being sandwiched between the conveying rollers 414 and conveyed to the conveying path Y2, and then it is placed on the preceding sheet S on the stacking tray 421.

A pressing means 422 moves with applying pressure on the backside of the paste spread surface of the preceding paper bulk stacked on the stacking tray 421 to ensure the adhesive bonding between sheets. Both lateral edges of the sheets S are positioned by means oedgeeral edge stoppers 423 and 424. Alignment and positioning of the front end, the rear end, and the lateral edges of the sheets S are performed before pressing with the pressing means 422. The pressing sheets S with the pressing means 422 can also be performed in such a way that a pressure is applied on stacked sheets every time each of the second and subsequent sheets S is placed on the stacking tray 421. Otherwise, a pressure may be applied on stacked sheets every time a plurality of sheets S are stacked.

With the above steps, a pasted booklet SA is completed. The case binding unit F1 is capable of binding, for example, a maximum of 200 sheets S with pasting.

In a part of the sheet stacking surface of the stacking tray 421, there is rotatably disposed a plurality of discharge belts 433 wound around the outside of a driving roller 431 and a follow-up roller 432.

The last sheet S is placed on the stacking tray 421 and pressed, thereby completing the booklet SA case-bound with pasting. The booklet SA slides on a stacking surface of the stacking tray 421 with the rear end of the booklet SA held by discharge pawls of the rotating discharge belts 433. It is then sandwiched between discharging rollers 435 provided in an outlet 436 and discharged to a cutting unit F2 (conveying path X2). Previous to the discharging process, the pressing means 422 and the lateral edge stopper 423 are retracted upward above the conveying path by means of a driving means, which is not shown.

In addition, the sheets S can be case-bound by means of stapling instead of pasting. In this case, the sheets S are covered with the cover sheet K and then stapled as described in the edge stapling machine D.

<Case Binding Cutting Function>

The case-bound booklet SA discharged from the outlet 436 of the case binding unit F1 is introduced into the cutting unit F2 and conveyed by a rotating conveying belt 451. It then stops at a predetermined position with the front end of the booklet SA abutting on a stopper 452.

At the stop position, cutting blades 453, 454, and 455 move down and cut the three-side edges other than the paste spread area of the booklet SA for finish machining thereof.

The finished booklet SA is conveyed to the front side of the case binding unit F1 (a conveying path Y3), discharged to the outside of the machine, and placed on a lifting delivery table (a case-bound paper stacking unit) 456. The lifting delivery table 456 can be provided with a carriage not shown so that it is detachable from the case binding machine body.

[Image Forming System]

Referring to FIGS. 23A to 23D, there are shown pattern diagrams of an embodiment of various image forming systems each comprising an image forming apparatus body A, a single-sheet processing machine B, and other postprocessing units (C, D, and F).

Each of the image forming systems in FIGS. 23A to 23D has the single-sheet processing machine B, the center stitching machine C, and the edge stapling machine D connected to the image forming apparatus body A on the side of a paper discharge unit 8 thereof.

Sheets S discharged without postprocessing of the postprocessing functions such as punching, folding, perforation, and slit cutting in the single-sheet processing machine B are accommodated in a sub-discharge tray 27 disposed at the top of the image forming system. Otherwise, they are conveyed to the center stitching machine C for the next step.

Sheets S processed with the postprocessing functions such as the punching or folding in the single-sheet processing machine B and unprocessed sheets S are introduced into the center stitching machine C. Sheets S not requiring the center stitching are discharged to a sub-discharge tray (top tray) 209. A booklet SA completed with single folding and center stitching in the center stitching machine C is accommodated in a discharge tray 256 disposed on the front side Cf of the center stitching machine C.

If the sheets S fed from the single-sheet processing machine B are to be edge-stapled and tape-bound with the postprocessing function, they pass through the center stitching machine C without any processing and are introduced to the edge stapling machine D. At this point, sheets S not requiring postprocessing such as the edge stapling and tape binding are discharged to a sub-discharge tray (top tray) 107.

A booklet SA processed with postprocessing such as edge stapling and tape binding in the edge stapling machine D is accommodated in the main discharge tray 120.

Figure 23A:
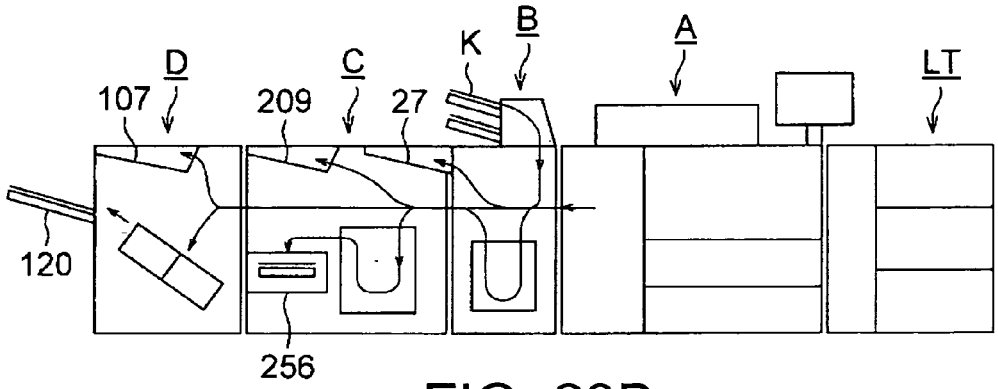
FIGS. 23A, 23B, 23C, and 23D are pattern diagrams of preferred embodiments of various image forming systems comprising an image forming apparatus, a single-sheet processing machine, and other postprocessing units.
Figure 23B:
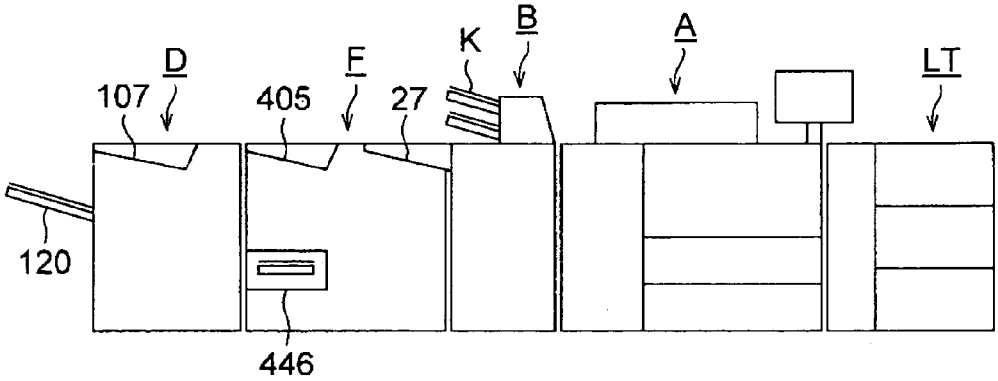

Referring to FIG. 23B, there is shown a pattern diagram of an image forming system where a case binding machine F is arranged instead of the center stitching machine C.

A booklet SA made by case-binding the sheets S fed from a single-sheet processing machine B is discharged to a lifting delivery table 456 disposed on the front side of the case binding machine F.

Sheets S not to be case-bound are discharged to a sub-discharge tray 209. Otherwise, they are conveyed to an edge stapling machine D for the next step. A booklet SA processed with the postprocessing such as edge stapling and tape binding in an edge stapling machine D is accommodated in the main discharge tray 120.

Figure 23C:
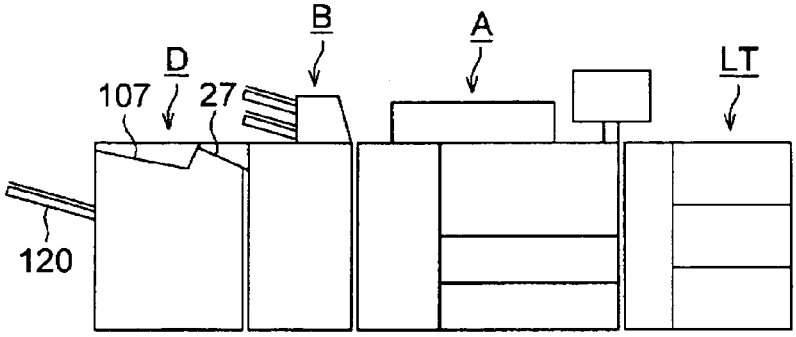

Referring to FIG. 23C, there is shown a pattern diagram of an image forming system comprising an image forming apparatus body A, a-single-sheet processing machine B, and an edge stapling machine D.

Sheets S processed with the postprocessing such as punching, foldout folding, or perforation are processed with edge stapling and tape binding in the edge stapling machine D.

Figure 23D:
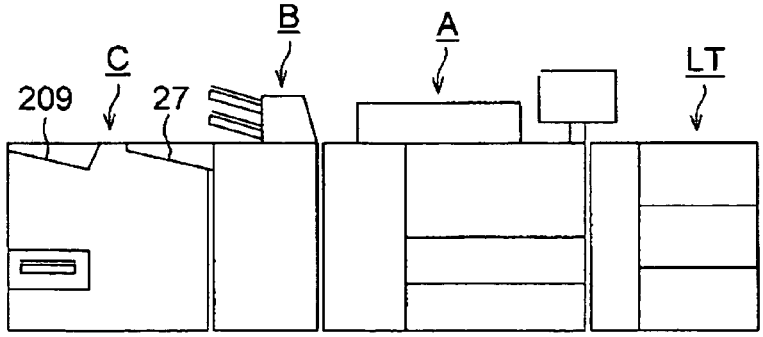

Referring to FIG. 23D, there is shown a pattern diagram of an image forming system comprising an image forming apparatus body A, a single-sheet processing machine B, and a center stitching machine C.

A cover sheet K fed from the single-sheet processing machine B is superimposed on sheets S fed from the image forming apparatus body A in the center stitching machine C, where single folding and center stitching postprocessing is performed.

Referring to FIGS. 24A to 24D, there are shown pattern diagrams of another embodiment of various image forming systems each comprising an image forming apparatus body A, an edge stapling machine D, and a high-volume stacker E.

Figure 24A:
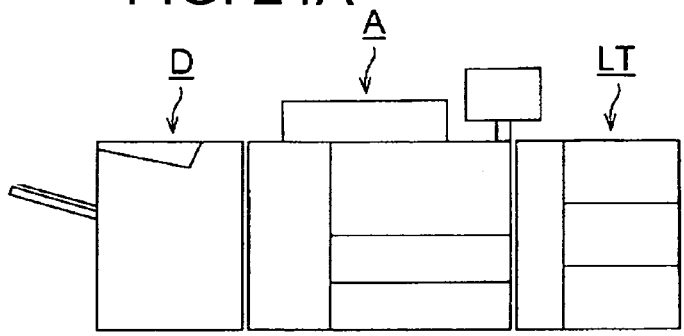
FIGS. 24A, 24B, 24C, and 24D are pattern diagrams of preferred embodiments of various image forming systems comprising an image forming apparatus, an edge stapling machine, and a high-volume stacker.

Referring to FIG. 24A, there is shown a pattern diagram of an image forming system comprising an image forming apparatus body A and an edge stapling machine D. This system is equivalent to such an arrangement that the single-sheet processing machine B is removed from the system in FIG. 23C. Sheets S discharged from the image forming apparatus body A are edge-stapled and tape-bound by the edge stapling machine D.

Figure 24B:
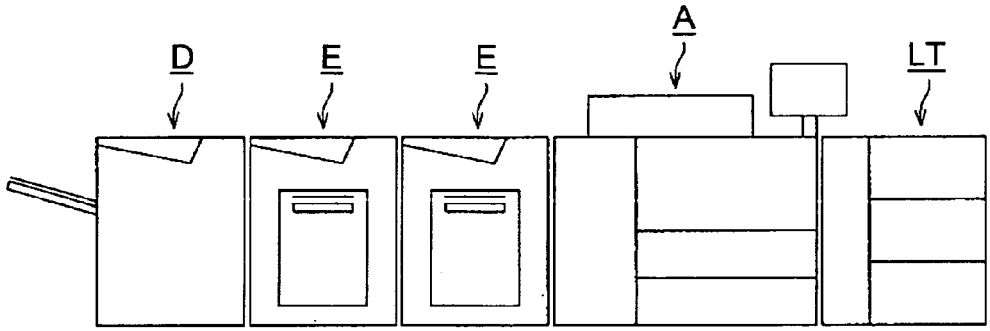

Referring to FIG. 24B, there is shown a pattern diagram of an image forming system comprising an image forming apparatus body A, two high-volume stackers E, and an edge stapling machine D. The system is equivalent to such an arrangement that two high-volume stackers E are placed between the components of the system in FIG. 24A. These two high-volume stackers E can accommodate a large volume of sheets S discharged from the image forming apparatus body A. In addition, the sheets S can be edge-stapled and tape-bound by means of the edge stapling machine D.

Figure 24C:
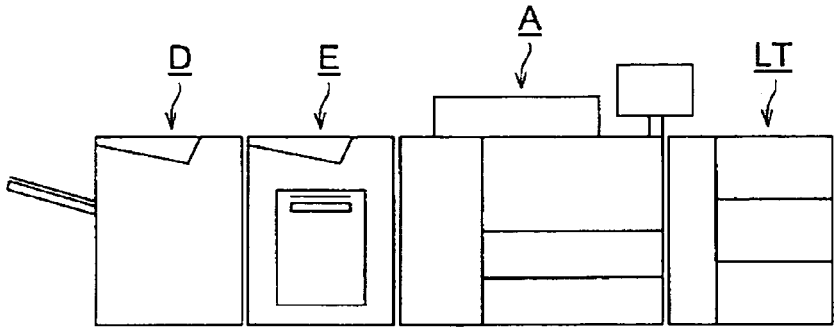

Referring to FIG. 24C, there is shown a pattern diagram of an image forming system comprising an image forming apparatus body A, a single high-volume stacker E, and an edge stapling machine D. The system is equivalent to such an arrangement that a high-volume stacker E is placed between the components of the system in FIG. 24A.

Figure 24D:
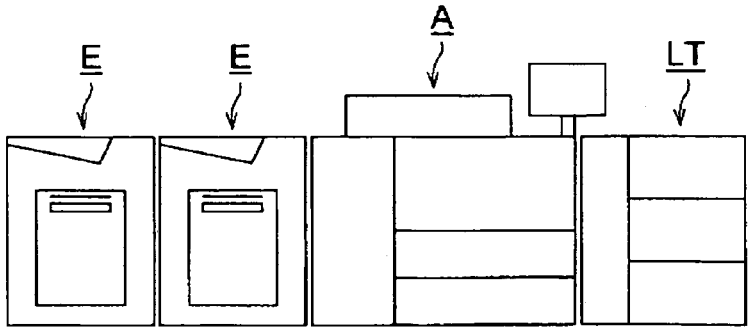

Referring to FIG. 24D, there is shown a pattern diagram of an image forming system comprising an image forming apparatus body A and two high-volume stackers E. The system is equivalent to such an arrangement that the edge stapling machine D is removed from the system shown in FIG. 24B. The two high-volume stackers E can accommodate a large volume of sheets S discharged from the image forming apparatus body A and the sheets can be pulled out to the front side of the high-volume stackers E.

<Number of Sheets Accommodated in Image Forming System>

The single-sheet processing machine B accommodates 500 cover sheets K in each stage of a two-stage paper feed tray 31. The center stitching machine C makes a booklet SA having 120 pages with double-sided printing by single-folding the maximum 30 sheets S. The edge stapling machine D makes a booklet SA by edge-stapling a maximum of 100 sheets S. The high-volume stacker E can accommodate a maximum of approx. 5,000 sheets S on the sheet stacking table 318. The case binding machine F makes a booklet SA by pasting a maximum of 100 sheets S.

<Application of the Image Forming System>

The image forming system according to the present invention is capable of selecting and performing processing such as punching, various fold processing, perforation, slit cutting, edge stapling, tape binding, case binding, center stitching, or cutting in accordance with all kinds of intended use by arbitrarily selecting and connecting the single-sheet processing machine B, the center stitching machine C, the edge stapling machine D, the high-volume stacker E, or the case binding machine F to the image forming apparatus body A.

Sophisticated publishing on demand is achieved with high speed and a large volume of output in multipurpose postprocessing in various-scale offices, print on demand industries, and data centers.

While the postprocessing units connected to the copying machine body has been described in the above embodiments, the present invention is also applicable to a system in which postprocessing units are connected to an image forming apparatus such as a printing on demand machine, a printer, a facsimile, or a complex machine. In addition, various processing can be performed by using the individual postprocessing units separated from the image forming apparatus.

Desired postprocessing units can be selectively attached out of the plurality types of postprocessing units according to the image forming system of the present invention. Therefore, a user can use an image forming system satisfying desired postprocessing functions.

Furthermore, various postprocessing functions can be divided into individual functions of a plurality of postprocessing units, thereby realizing enough performance levels of individual postprocessing functions.

Still further, the single-sheet processing machine has a plurality of single-sheet processing functions of postprocessing in units of a sheet and a sheet attachment function of attaching a cover sheet or an insert sheet to a paper bulk. Therefore, the single-sheet processing machine can be integrally provided with the single-sheet processing functions used in common for a plurality of other types of postprocessing.

Accordingly, there is no need for providing each of other postprocessing units with the same function and therefore there is no overlap in functions in the entire image forming system. This enables downsizing the image forming system and decreasing the number of components. In addition, there is no need for providing another postprocessing unit, for example, having only a sheet attachment function, thereby enabling downsizing of the entire image forming system including the sheet attachment function.

Furthermore, if sheets are postprocessed in units of a sheet, the configuration can be relatively simplified and downsized in comparison with a case of postprocessing a paper bulk made of a plurality of sheets at a time.

Therefore, the plurality of processing mechanisms integrated into the single-sheet processing machine leads to downsizing the entire image forming system.

What is claimed is:

1. An image forming system, comprising:

an image forming apparatus body for forming an image on a cut sheet; and a single-sheet processing machine selectively attached to the image forming apparatus body and attached to a postprocessing machine arranged at a downstream position with respect to the single-sheet processing machine, wherein the single-sheet processing machine has at least two or more types of postprocessing units, the units including a punching unit for punching sections of the cut sheet, a folding unit for folding sections of the cut sheet, a perforator for perforating sections of the cut sheet, and a cutter for cutting sections of the cut sheet, and wherein the single-sheet processing machine includes a sheet attachment unit for attaching a cover sheet or an insert sheet to a bulk of the cut sheets.

2. The image forming system of claim 1, wherein said single-sheet processing machine has all single-sheet processing mechanisms configured to post-process sheet in units of a sheet as performed by the image forming system.

3. The image forming system of claim 1, wherein said single-sheet processing machine has a single-sheet processing carry-in unit for receiving a sheet conveyed from the image forming apparatus body and a single-sheet processing carry-out unit for discharging the sheet to any other postprocessing unit, wherein the single-sheet processing machine is directly attached to the image forming apparatus body without intervention of any other postprocessing unit.

4. The image forming system of claim 1, wherein said single-sheet processing machine has the punching unit and the folding unit, the folding unit arranged on the downstream side of the punching unit in the sheet conveying direction.

5. The image forming system of claim 1, wherein said single-sheet processing machine includes:

a single-sheet processing carry-in unit for receiving a sheet conveyed from said image forming apparatus body;

a single-sheet processing carry-out unit for discharging the sheet to any other postprocessing unit;

a first processing unit for postprocessing sheet in units of a sheet;

a second processing unit for postprocessing sheet in units of a sheet, the second processing unit arranged on the downstream side of the first processing unit in the sheet conveying direction;

a first conveying path for conveying the sheet received by the single-sheet processing carry-in unit to the single-sheet processing carry-out unit without intervention of the first processing unit and the second processing unit;

a second conveying path for conveying the sheet received by the single-sheet processing carry-in unit to the first processing unit;

a third conveying path for conveying the sheet from the first processing unit to said second processing unit; and a fourth conveying path for conveying the sheet from the second processing unit to the first conveying path.

6. The image forming system of claim 5, wherein the third conveying path of said single-sheet processing machine has a third A conveying path for conveying a sheet having a length no more than a predetermined length in the sheet feeding direction to the second processing unit and a third B conveying path for conveying a sheet having a length more than the predetermined length in the sheet feeding direction to the second processing unit.

7. The image forming system of claim 5, wherein said single-sheet processing machine has a fifth conveying path for conveying the cover sheets or the insert sheets from the sheet attachment unit to the first conveying path.

8. The image forming system of claim 7, wherein said single-sheet processing machine has a branching portion where the conveying path branches out into the first conveying path and the second conveying path on the downstream side of the single-sheet processing carry-in unit in the sheet conveying direction and a joining portion where the fifth conveying path joins the first conveying path on the upstream side of the branching portion in the sheet conveying direction.

9. The image forming system of claim 5, wherein said single-sheet processing machine has a single-sheet processing discharge unit for discharging remaining sheets in the image forming system at an occurrence of a sheet jam or a test-recorded sheet for use in checking an image recording condition and a sixth conveying path for conveying sheets from the first conveying path to the single-sheet processing discharge unit.

10. The image forming system of claim 1, further comprising an edge stapling machine configured to bind a sheet bulk made of a plurality of sheets at an edge thereof, wherein said edge stapling machine has an edge stapling carry-in unit for receiving sheets conveyed from the single-sheet processing machine or from any other postprocessing unit, and the edge stapling machine is attached at the downstream side of said single-sheet processing machine in the sheet conveying direction.

11. The image forming system of claim 10, wherein said edge stapling machine has at least one of a stapler of stapling the sheet bulk, a tape binder of tape-binding the sheet bulk, and a pasting binder of pasting the sheet bulk, for the edge binding of the sheet bulk.

12. The image forming system of claim 10, wherein said edge stapling machine has an open discharge unit for discharging the sheet bulk made of a plurality of bound sheets at the side of the image forming system, and is attachable in the most downstream of the image forming system in the sheet conveying direction.

13. The image forming system of claim 10, wherein said edge stapling machine has an edge stapling discharge unit for discharging remaining sheets in the image forming system at an occurrence of a sheet jam or a test-recorded sheet for use in checking an image recording condition.

14. The image forming system of claim 1, further comprising:

a center stitching machine for folding and stitching the bulk of the cut sheets, the center stitching machine attached to the single-sheet processing machine at a downstream position with respect to a sheet conveying direction, wherein the center stitching machine includes a center stitching carry-in unit for receiving sheets conveyed from the single-sheet processing machine or any other postprocessing unit attached at an upstream position with respect to the sheet conveying direction, and a center stitching carry-out unit for conveying sheets to any other postprocessing unit attached at the downstream position with respect to the sheet conveying direction.

15. The image forming system of claim 14, wherein the center stitching machine includes a stapling mechanism for stitching the bulk of the cut sheets.

16. The image forming system of claim 14, wherein the center stitching machine includes a folding unit for folding the stitched bulk of the cut sheets and a sheet trimmer for cutting the folded bulk of the cut sheets.

17. The image forming system of claim 14, wherein the center stitching machine includes a center stitching discharge unit for discharging sheets remaining in the image forming system during a sheet jam or a test-recorded sheet used for checking an image recording condition.

18. The image forming system of claim 14, wherein the center stitching machine includes a center-stitched sheet stacking unit movable relative to the center stitching machine for stacking the center stitched bulk of the cut sheets.

19. The image forming system of claim 1, further comprising a case binding machine configured to case-bind a sheet bulk made of a plurality of sheets with a cover sheet, wherein said case binding machine is attached at the downstream side of said single-sheet processing machine in the sheet conveying direction.

20. The image forming system of claim 19, wherein said case binding machine has a pasting unit of pasting the sheet bulk or a stapling unit of binding the sheet bulk.

21. The image forming system of claim 19, wherein said case binding machine has a case-bound sheet cutting unit configured to cut the case-bound sheet bulk.

22. The image forming system of claim 19, wherein said case binding machine has a case binding discharge unit for discharging remaining sheet in the image forming system at an occurrence of a sheet jam or a test-recorded sheet for use in checking an image recording condition.

23. The image forming system of claim 19, wherein said case binding machine has a case-bound sheet stacking unit where a case-bound sheet bulk is placed and which is movable relative to the case binding machine body.

24. A single-sheet processing machine which is attachable to an image forming apparatus body and is configured to attach another postprocessing unit at a downstream side, having a plurality of mechanisms including a punching unit configured to punch sheets in units of a sheet, a folding unit configured to fold sheets in units of a sheet, a perforator configured to perforate sheets in units of a sheet, and a cutter configured to cut sheets in units of a sheet, and a sheet attachment unit configured to attach a cover sheet or an insert sheet to an output sheet bulk.

* * * * *